US007134501B2

(12) United States Patent
Johnson et al.

(10) Patent No.: US 7,134,501 B2
(45) Date of Patent: Nov. 14, 2006

(54) EXPANDABLE SAND SCREEN AND METHODS FOR USE

(75) Inventors: Craig D. Johnson, Montgomery, TX (US); Matthew R. Hackworth, Pearland, TX (US); Patrick W. Bixenman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/776,095

(22) Filed: Feb. 11, 2004

(65) Prior Publication Data

US 2004/0163819 A1 Aug. 26, 2004

(51) Int. Cl.
*E21B 43/08* (2006.01)
*E21B 43/10* (2006.01)

(52) U.S. Cl. ..... 166/369; 166/207; 166/227

(58) Field of Classification Search ..... 166/278, 166/227, 207, 382, 384, 235, 236, 51
See application file for complete search history.

(56) References Cited

U.S. PATENT DOCUMENTS

| | | | | |
|---|---|---|---|---|
| 261,252 | A | 7/1882 | Olmstead | |
| 1,135,809 | A | 4/1915 | Jones | |
| 1,229,437 | A | 6/1917 | Foster | |
| 2,677,466 | A * | 5/1954 | Lowe | 210/489 |
| 2,769,655 | A * | 11/1956 | Holmes | 294/86.25 |
| 2,812,025 | A * | 11/1957 | Teague et al. | 166/207 |
| 2,835,328 | A | 5/1958 | Thompson | |
| 2,990,017 | A | 6/1961 | Powers | |
| 3,297,092 | A | 1/1967 | Jennings | |
| 3,353,599 | A | 11/1967 | Swift | |
| 3,482,629 | A | 12/1969 | Suman, Jr. | |
| 5,348,095 | A | 9/1994 | Worrall et al. | |
| 5,366,012 | A * | 11/1994 | Lohbeck | 166/277 |
| 5,667,011 | A | 9/1997 | Gill et al. | |
| 5,901,789 | A * | 5/1999 | Donnelly et al. | 166/381 |
| 6,012,522 | A | 1/2000 | Donnelley et al. | |
| 6,263,966 | B1 | 7/2001 | Haut et al. | |
| 6,263,972 | B1 | 7/2001 | Richard et al. | |
| 6,315,040 | B1 * | 11/2001 | Donnelly | 166/207 |
| 6,382,318 | B1 * | 5/2002 | Whitlock | 166/278 |
| 6,415,509 | B1 * | 7/2002 | Echols et al. | 29/896.62 |
| 6,457,518 | B1 * | 10/2002 | Castano-Mears et al. | 166/207 |
| 6,478,091 | B1 * | 11/2002 | Gano | 166/373 |
| 6,488,702 | B1 | 12/2002 | Besselink | |
| 6,571,871 | B1 * | 6/2003 | Lauritzen et al. | 166/227 |
| 6,695,054 | B1 * | 2/2004 | Johnson et al. | 166/278 |
| 6,725,934 | B1 * | 4/2004 | Coronado et al. | 166/313 |

FOREIGN PATENT DOCUMENTS

| | | |
|---|---|---|
| EP | 0 674 095 | 9/1995 |

(Continued)

OTHER PUBLICATIONS

Docket Sheet for *Memry Corporation* v. *Kentucky Oil Technology, N.V.*, Case No. H-04-1959 (S.D. Tex.) (PACER Jun. 2, 2005) (5 pages).

(Continued)

*Primary Examiner*—Kenneth Thompson
(74) *Attorney, Agent, or Firm*—Robert A. Van Someren; Kevin P. McEnaney; Jaime A. Castano

(57) ABSTRACT

A particulate screen suitable for use in a wellbore. The particulate screen is expandable and may be at least partially formed of a bistable tubular. Also, a filter media may be combined with the bistable tubular to limit influx of particulates.

16 Claims, 18 Drawing Sheets

FOREIGN PATENT DOCUMENTS

| | | |
|---|---|---|
| WO | WO 96/37680 | 11/1996 |
| WO | WO 98/00626 | 1/1998 |
| WO | WO 98/22690 | 5/1998 |
| WO | WO 98/26152 | 6/1998 |
| WO | WO 98/32412 | 7/1998 |
| WO | WO 98/49423 | 11/1998 |
| WO | WO 99/02818 | 1/1999 |
| WO | WO 99/23354 | 5/1999 |
| WO | WO 200008301 A2 * | 2/2000 |
| WO | WO 2004/014255 | 2/2004 |

OTHER PUBLICATIONS

Docket Sheet for *Memry Corporation* v. *Kentucky Oil Technology, N.V.*, Case No. C-04-03843, (N.D. Cal.) (PACER Aug. 11, 2005) (13 pages).

Communication from United States District Court Transferring Case, *Memry Corporation* v. *Kentucky Oil Technology, N.V.*, Case No. H-04-1959 (S.D. Tex.), dated Sep. 7, 2004 (1 page).

Plaintiffs' Original Complaint, *Memry Corporation* v. *Kentucky Oil Technology, N.V.*, Case No. H-04-1959, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern District of California, *Memry Corporation* v. *Kentucky Oil Technology, N.V.*, Case No. H-04-1959, (S.D. Tex.), filed Jul. 7, 2004 (49 pages).

Plaintiff's First Amended Complaint, *Memry Corporation* v. *Kentucky Oil Technology, N.V.*, Case No. C-04-03843, (N.D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology, N.V.*, Case No. C-04-03843, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology, N.V.*, Case No. C-04-03843, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.*, Case No. C-04-03843, (N.D. Cal.) filed Jan. 24, 2005 (32 pages).

[Proposed] Order Granting Schlumberger Technology Corporation's Motion to Dismiss Kentucky Oil Technology's Third, Fourth, Fifth, and Sixth Counterclaims, *Memry Corporation* v. *Kentucky Oil Technology, N.V.*, Case No. C-04-03843, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology, N.V.*, Case No. C-04-03843, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Six Counterclaims; and Memorandum of Points and Authorities, *Memry Corporation* v. *Kentucky Oil Technology, N.V.*, Case No. C-04-03843, (N.D. Cal.), filed Feb. 24, 2005 (32 pages).

Request for Judicial Notice in Support of Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.* Case No. C-04-03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.*, Case No. C-04-03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.*, Case No. C-04-03843, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology, N.V.*, Case No. C-04-03843, (N.D. Cal.), filed Feb. 25, 2005 (3 pages).

[Proposed] Order Granting Memry Corporation's Motion to Dismiss Kentucky Oil Technology's Third Fourth, Fifth, and Sixth Counterclaims, *Memry Corporation* v. *Kentucky Oil Technology, N.V.*, Case No. C-04-03843, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology, N.V.*, Case No. C-04-03843, (N.D. Cal.), filed Mar. 11, 2005 (29 pages).

Kentucky Oil's Opposition to Counterdefendants' Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology, N.V.*, Case No. C-04-03843, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology, N.V.*, Case No. C-04-03843, (N.D. Cal.), filed Mar. 18, 2005 (9 pages).

Plaintiff and Counterdefendant Memry Corporation's Reply in Support of Request for Judicial Notice, *Memry Corporation* v. *Kentucky Oil Technology. N.V.*, Case No. C-04-03843, (N.D. Cal.), filed Mar. 18, 2005 (4 pages).

Reply of Schlumberger Technology Corporation to Kentucky Oil Technology's Opposition to First Amended, Third, Fourth, Fifth, and Sixth Counterclaims, *Memry Corporation* v. *Kentucky Oil Technology, N.V.*, Case No. C-04-03843, (N.D. Cal.), filed Mar. 18, 2005 (17 pages).

Schlumberger's Response to Kentucky Oil's Opposition to Counterdefendants' Request for Judicial Notice, *Memry Corporation* v. *Kentucky Oil Technology, N.V.*, Case No. C-04-03843, (N.D. Cal.), filed Mar. 18, 2005 (3 pages).

Schlumberger's Notice of Motion and Motion to Strike Exhibits 1, 2, and 4 to the Declaration of Nicola A. Pisano, *Memry Corporation* v. *Kentucky Oil Technology, N.V.*, Case No. C-04-03843, (N.D. Cal.), filed Mar. 18, 2005 (3 pages).

Kentucky Oil's Opposition to STC's Motion to Strike Exhibits 1, 3 and 4 to the Declaration of Nicola A. Pisano, *Memry Corporation* v. *Kentucky Oil Technology, N.V.*, Case No. C-04-03843, (N.D. Cal.), filed Mar. 25, 2005 (3 pages).

Kentucky Oil's Notice of Motion and Motion to Strike Declaration of Benjamin Holl and Portions of Counterdefendants' Reply Briefs, *Memry Corporation* v. *Kentucky Oil Technology, N.V.*, Case No. C-04-03843, (N.D. Cal.), filed Mar. 25, 2005 (4 pages).

[Proposed] Order Granting Kentucky Oil's Motion to Strike Declaration of Benjamin Holl and Portions of Counterdefendants' Reply Briefs, *Memry Corporation* v. *Kentucky Oil Technology, N.V.*, Case No. C-04-03843, (N.D. Cal), entered Mar. 25, 2005 (2 pages).

Order Granting in Part and Denying in Part Counterdefendants' Motion to Dismiss, *Memry Corporation* v. *Kentucky Oil Technology, N.V.*, Case No. C-04-03843, (N.D. Cal.), entered Apr. 8, 2005 (26 pages).

Plaintiff and Counterdefendant Memry Corporation's Reply to Kentucky Oil Technology N.V.'s Counterclaims and Demand for Jury Trial, *Memry Corporation* v. *Kentucky Oil Technology, N.V.*, Case No. C-04-03843, (N.D. Cal.) filed Apr. 18, 2005 (8 pages).

Second Amended Counterclaims of Kentucky Oil Technology N.V. Against Memry Corporation and Schlumberger Technology Corporation, *Memry Corporation* v. *Kentucky Oil Technology, N.V.*, Case No. C-04-03843, (N.D. Cal.), filed May 6, 2005 (20 pages).

Plaintiff Memry Corporation's Reply to Kentucky Oil Technology N.V.'s Second Amended Counterclaims and Demand for Jury Trial, *Memry Corporation* v. *Kentucky Oil Technology, N.V.*, Case No. C-04-03843, (N.D. Cal.), filed Jun. 3, 2005 (9 pages).
Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology, N.V.*, Case No. C-04-03843, (N.D. Cal.), filed Jun. 3, 2005 (18 pages).
Opposition of Kentucky Oil Technology to Schlumberger Technology Corporation's Motion to Dismiss Kentucky Oil's Second Amended Counterclaims, *Memry Corporation* v. *Kentucky Oil Technology, N.V.*, Case No. C-04-03843, (N.D. Cal.), filed Jun. 17, 2005 (16 pages).
Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, Case No. C-04-03843, (N.D. Cal.), filed Jun. 24, 2005 (11 pages).
Order Granting in Part and Denying In Part STC's Motion to Dismiss, *Memry Corporation* v. *Kentucky Oil Technology, N.V.*, Case No. C-04-03843, (N.D. Cal.), entered Jul. 14, 2005 (8 pages).
Schlumberger Technology Corporation's Answer to Kentucky Oil Technology's Second Amended Counterclaims, *Memry Corporation* v. *Kentucky Oil Technology, N.V.*, Case No. C-04-03843, (N.D. Cal.), filed Jul. 28, 2005 (8 pages).
Notice o Motion and Motion by Kentucky Oil To Compel Production of Documents by Schlumberger Technology Corporation Pursuant to Fed. R. Civ. Rule 37; Memorandum of Points and Authorities in Support Thereof; Declaration of Michael Bierman, *Memry Corporation* v. *Kentucky Oil Technology, N.V.*, Case No. C-04-03843, (N.D. Cal.), filed Jul. 28, 1005 (32 pages).
Schlumberger Technology Corporation's Opposition to Kentucky Oil Technology's Motion to Compel, *Memry Corporation* v. *Kentucky Oil Technology, N.V.*, Case No. C-04-03843, (N.D. Cal.), filed Aug. 4, 2005 (21 pages).
Declaration of David B. Moyer in Support of Schlumberger Technology Corporation's Opposition to Kentucky Oil Technology's Motion to Compel, *Memry Corporation* v. *Kentucky Oil Technology, N.V.*, Case No. C-04-03843, (N.D. Cal.), filed Aug. 4, 2005 (52 pages).
Kentucky Oil's Reply in Support of Motion to Compel, *Memry Corporation* v. *Kentucky Oil Technology, N.V.*, Case No. C-04-03843, (N.D. Cal.), filed Aug. 10, 2005 (18 pages).
Declaration of Nicola A. Pisano in Support of Kentucky Oil's Motion to Compel, *Memry Corporation* v. *Kentucky Oil Technology, N.V.*, Case No. C-04-03843, (N.D. Cal.), filed Aug. 10, 2005 (69 pages).
Order Granting Kentucky Oil's Motion to Compel Production of Documents, *Memry Corporation* v. *Kentucky Oil Technology, N.V.*, Case No. C-04-03843, (N.D. Cal.), entered Aug. 17, 2005 (8 pages).
Besselink, Peter; Biflex Stents; SMST-99: Proceedings of the First European Conference on Shape Memory and Superelastic Technologies, Antwerp Zoo, Belgium, 1999, pp. 142-150.
US 6,706,063, 03/2004, Besselink (withdrawn)

* cited by examiner

EXPANDABLE SAND SCREEN AND METHODS FOR USE

CROSS REFERENCE TO RELATED APPLICATIONS

The following is based on and claims the priority of U.S. patent application Ser. No. 10/021,724, filed Dec. 12, 2001, which is based on and claims priority of provisional application number 60/261,752 filed Jan. 16, 2001, provisional application number 60/286,155 filed Apr. 24, 2001 and provisional application No. 60/296,042 filed Jun. 5, 2001.

FIELD OF THE INVENTION

This invention relates to equipment that can be used in the drilling and completion of boreholes in an underground formation and in the production of fluids from such wells.

BACKGROUND OF THE INVENTION

Fluids such as oil, natural gas and water are obtained from a subterranean geologic formation (a "reservoir") by drilling a well that penetrates the fluid-bearing formation. Once the well has been drilled to a certain depth the borehole wall must be supported to prevent collapse. Conventional well drilling methods involve the installation of a casing string and cementing between the casing and the borehole to provide support for the borehole structure. After cementing a casing string in place, the drilling to greater depths can commence. After each subsequent casing string is installed, the next drill bit must pass through the inner diameter of the casing. In this manner each change in casing requires a reduction in the borehole diameter. This repeated reduction in the borehole diameter results in a requirement for very large initial borehole diameters to permit a reasonable pipe diameter at the depth where the wellbore penetrates the producing formation. The need for larger boreholes and multiple casing strings results in the use of more time, material and expense than if a uniform size borehole could be drilled from the surface to the producing formation.

Various methods have been developed to stabilize or complete uncased boreholes. U.S. Pat. No. 5,348,095 to Worrall et al. discloses a method involving the radial expansion of a casing string to a configuration with a larger diameter. Very large forces are needed to impart the radial deformation desired in this method. In an effort to decrease the forces needed to expand the casing string, methods that involve expanding a liner with longitudinal slots cut into it have been proposed (U.S. Pat. Nos. 5,366,012 and 5,667,011). These methods involve the radial deformation of the slotted liner into a configuration having an increased diameter by running an expansion mandrel through the slotted liner. Such methods still require significant amounts of force to be applied throughout the entire length of the slotted liner.

In some drilling operations, another problem encountered is the loss of drilling fluids into subterranean zones. The loss of drilling fluids usually leads to increased expenses but also can result in a borehole collapse and a costly "fishing" job to recover the drill string or other tools that were in the well. Various additives, e.g. cottonseed hulls or synthetic fibers, are commonly used within the drilling fluids to help seal off loss circulation zones.

Furthermore, once a well is put in production an influx of sand from the producing formation can lead to undesired fill within the wellbore and can damage valves and other production related equipment. There have been many attempted methods for controlling sand. For example, some wells utilize sand screens to prevent or restrict the inflow of sand and other particulate matter from the formation into the production tubing. The annulus formed between the sand screen and the wellbore wall is packed with a gravel material in a process called a gravel pack.

The present invention is directed to overcoming, or at least reducing the effects of one or more of the problems set forth above, and can be useful in other applications as well.

SUMMARY OF THE INVENTION

In one aspect of the present invention, a technique is provided for controlling the influx of sand or other particulates into a wellbore from a geological formation. The technique utilizes an expandable member that may be deployed at a desired location in a wellbore and then expanded outwardly. When expanded, the device is better able to facilitate flow while filtering particulate matter.

BRIEF DESCRIPTION OF THE DRAWINGS

The invention will hereafter be described with reference to the accompanying drawings, wherein like reference numerals denote like elements, and.

Figure 1A:
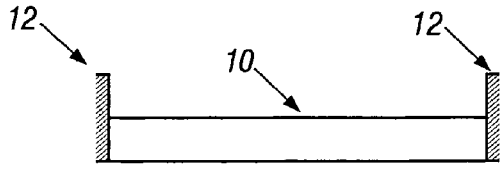
FIGS. 1A and 1B are illustrations of the forces imposed to make a bistable structure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF EXEMPLARY EMBODIMENTS

Figure 1B:
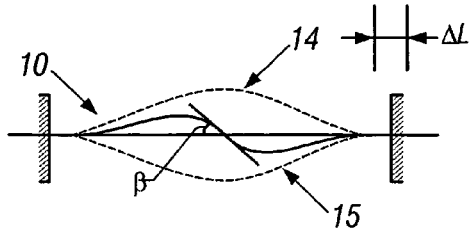

Bistable devices used in the present invention can take advantage of a principle illustrated in FIGS. 1A and 1B. FIG. 1A shows a rod 10 fixed at each end to rigid supports 12. If the rod 10 is subjected to an axial force it begins to deform as shown in FIG. 1B. As the axial force is increased rod 10 ultimately reaches its Euler buckling limit and deflects to one of the two stable positions shown as 14 and 15. If the buckled rod is now clamped in the buckled position, a force at right angles to the long axis can cause the rod to move to either of the stable positions but to no other position. When the rod is subjected to a lateral force it must move through an angle β before deflecting to its new stable position.

Figure 2A:
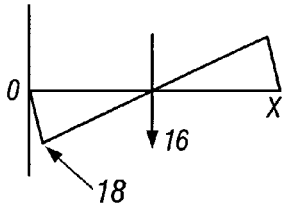
FIGS. 2A and 2B show force-deflection curves of two bistable structures.
Figure 2B:
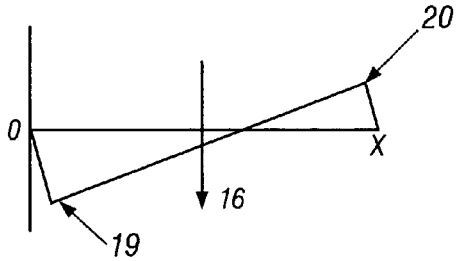

Bistable systems are characterized by a force deflection curve such as those shown in FIGS. 2A and 2B. The externally applied force 16 causes the rod 10 of FIG. 1B to move in the direction X and reaches a maximum 18 at the onset of shifting from one stable configuration to the other. Further deflection requires less force because the system now has a negative spring rate and when the force becomes zero the deflection to the second stable position is spontaneous.

The force deflection curve for this example is symmetrical and is illustrated in FIG. 2A. By introducing either a precurvature to the rod or an asymmetric cross section the force deflection curve can be made asymmetric as shown in FIG. 2B. In this system the force 19 required to cause the rod to assume one stable position is greater than the force 20 required to cause the reverse deflection. The force 20 must be greater than zero for the system to have bistable characteristics.

Bistable structures, sometimes referred to as toggle devices, have been used in industry for such devices as flexible discs, over center clamps, hold-down devices and quick release systems for tension cables (such as in sailboat rigging backstays).

Figure 3A:
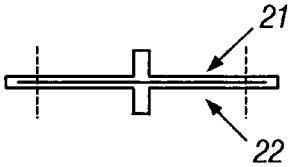
FIGS. 3A–3F illustrate expanded and collapsed states of three bistable cells with various thickness ratios.
Figure 3C:
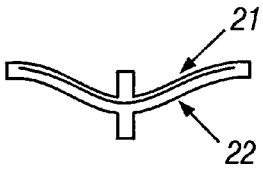
Figure 3E:
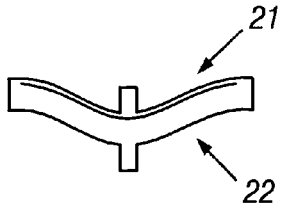
Figure 3B:
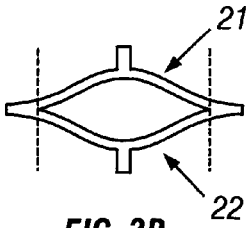
Figure 3D:
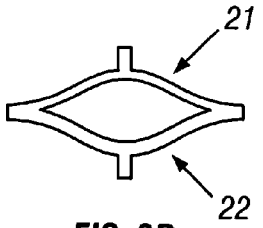
Figure 3F:
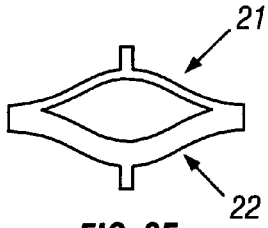

Instead of using the rigid supports as shown in FIGS. 1A and 1B, a cell can be constructed where the restraint is provided by curved struts connected at each end as shown in FIGS. 3A–3F. If both struts 21 and 22 have the same thickness as shown in FIGS. 3A and 3B, the force deflection curve is linear and the cell lengthens when compressed from its open position FIG. 3B to its closed position FIG. 3A. If the cell struts have different thicknesses, as shown in FIGS. 3C–3F, the cell has the force deflection characteristics shown in FIG. 2B, and does not change in length when it moves between its two stable positions. An expandable bistable tubular can thus be designed so that as the radial dimension expands, the axial length remains constant. In one example, if the thickness ratio is over approximately 2:1, the heavier strut resists longitudinal changes. By changing the ratio of thick-to-thin strut dimensions, the opening and closing forces can be changed. For example, FIGS. 3C and 3D illustrated a thickness ratio of approximately 3:1, and FIGS. 3E and 3F illustrate a thickness ratio of approximately 6:1.

Figure 4A:
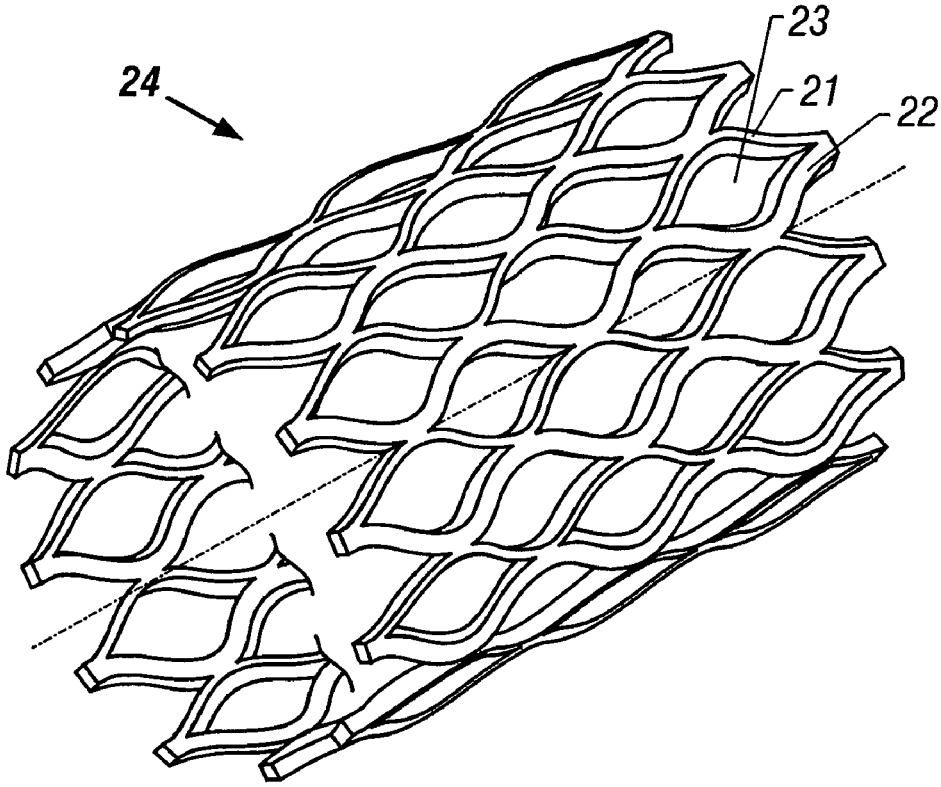
FIGS. 4A and 4B illustrate a bistable expandable tubular in its expanded and collapsed states.
Figure 4B:
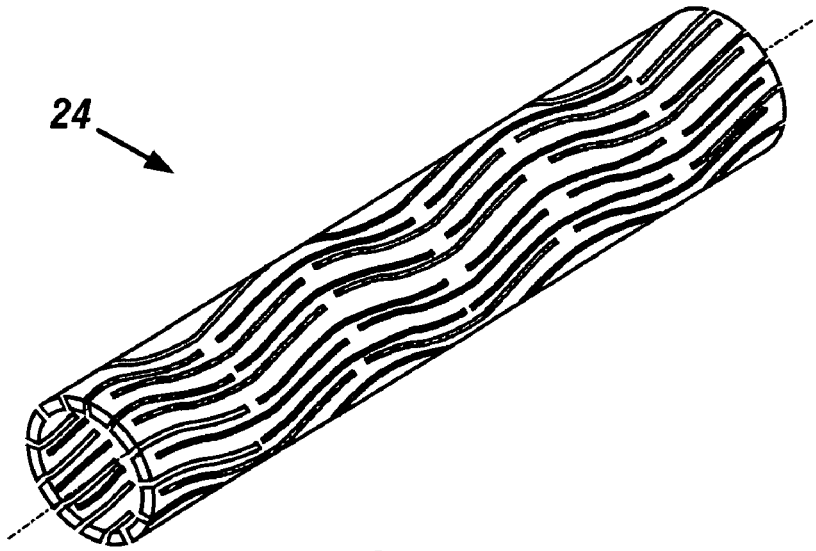
Figure 4C:
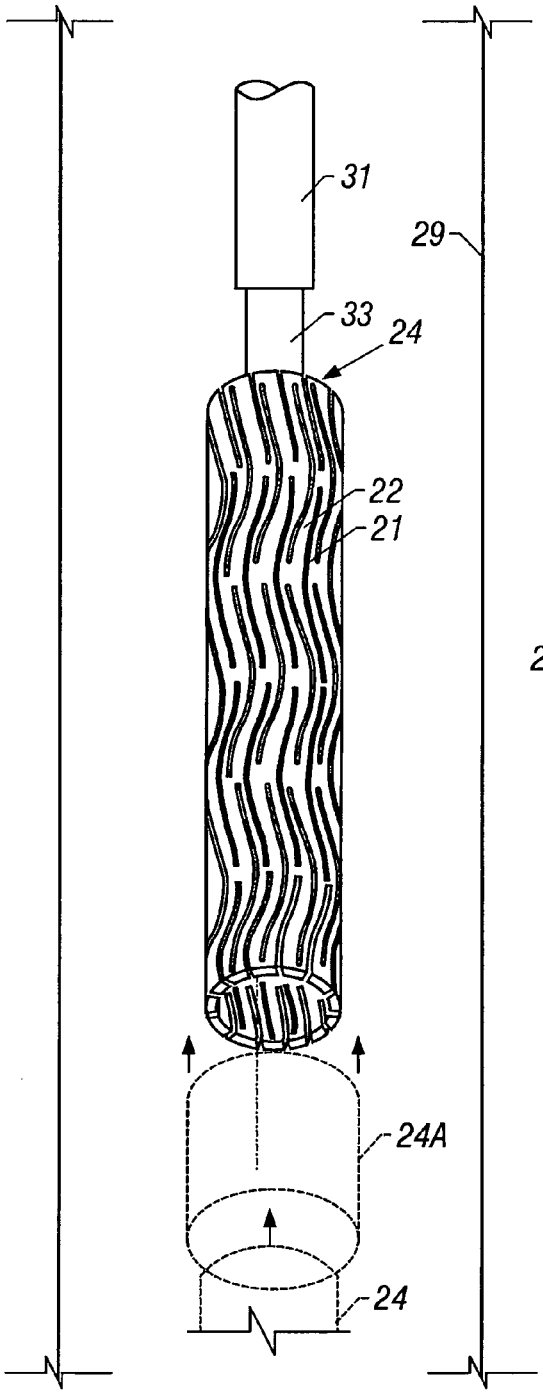
FIGS. 4C and 4D illustrate a bistable expandable tubular in collapsed and expanded states within a wellbore.
Figure 4D:
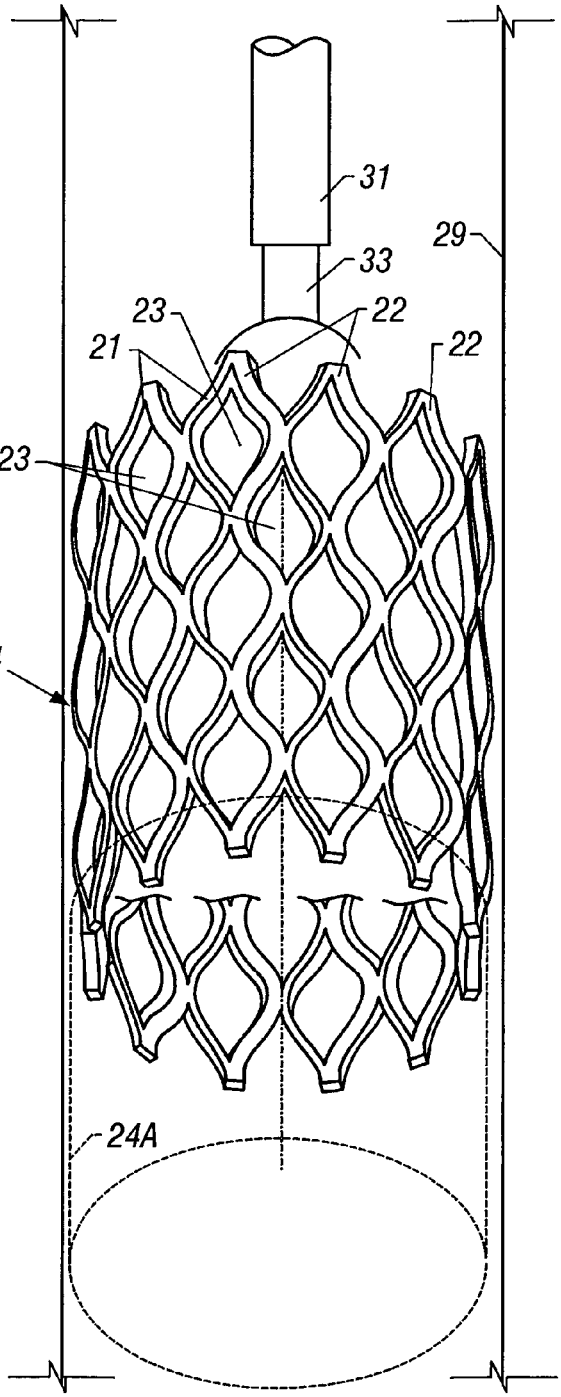

An expandable bore bistable tubular, such as casing, a tube, a patch, or pipe, can be constructed with a series of circumferential bistable connected cells 23 as shown in FIGS. 4A and 4B, where each thin strut 21 is connected to a thick strut 22. The longitudinal flexibility of such a tubular can be modified by changing the length of the cells and by connecting each row of cells with a compliant link. Further, the force deflection characteristics and the longitudinal flexibility can also be altered by the design of the cell shape. FIG. 4A illustrates an expandable bistable tubular 24 in its expanded configuration while FIG. 4B illustrates the expandable bistable tubular 24 in its contracted or collapsed configuration. Within this application the term "collapsed" is used to identify the configuration of the bistable element or device in the stable state with the smallest diameter, it is not meant to imply that the element or device is damaged in any way. In the collapsed state, bistable tubular 24 is readily introduced into a wellbore 29, as illustrated in FIG. 4C. Upon placement of the bistable tubular 24 at a desired wellbore location, it is expanded, as illustrated in FIG. 4D.

The geometry of the bistable cells is such that the tubular cross-section can be expanded in the radial direction to increase the overall diameter of the tubular. As the tubular expands radially, the bistable cells deform elastically until a specific geometry is reached. At this point the bistable cells move, e.g. snap, to a final expanded geometry. With some materials and/or bistable cell designs, enough energy can be released in the elastic deformation of the cell (as each bistable cell snaps past the specific geometry) that the expanding cells are able to initiate the expansion of adjoining bistable cells past the critical bistable cell geometry. Depending on the deflection curves, a portion or even an entire length of bistable expandable tubular can be expanded from a single point.

In like manner if radial compressive forces are exerted on an expanded bistable tubular, it contracts radially and the bistable cells deform elastically until a critical geometry is reached. At this point the bistable cells snap to a final collapsed structure. In this way the expansion of the bistable tubular is reversible and repeatable. Therefore the bistable tubular can be a reusable tool that is selectively changed between the expanded state as shown in FIG. 4A and the collapsed state as shown in FIG. 4B.

In the collapsed state, as in FIG. 4B, the bistable expandable tubular is easily inserted into the wellbore and placed into position. A deployment device is then used to change the configuration from the collapsed state to the expanded state.

In the expanded state, as in FIG. 4A, design control of the elastic material properties of each bistable cell can be such that a constant radial force can be applied by the tubular wall to the constraining wellbore surface. The material properties and the geometric shape of the bistable cells can be designed to give certain desired results.

Figure 11:
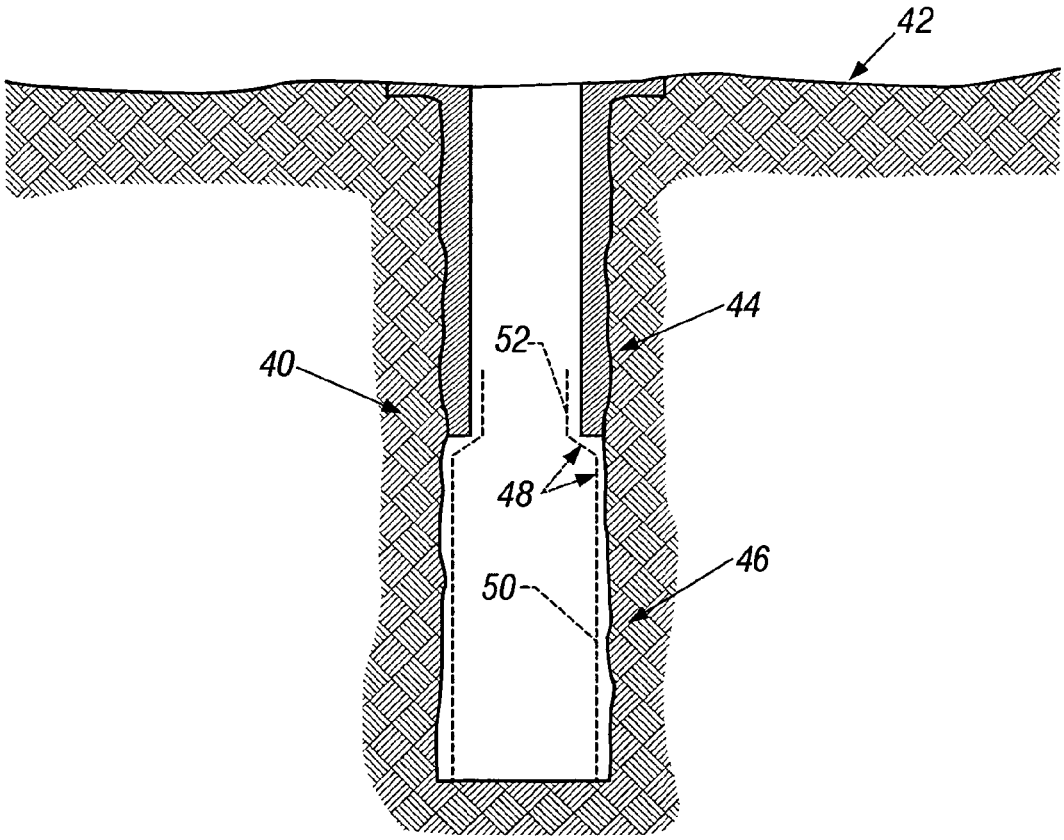
FIG. 11 is a schematic of a wellbore utilizing an expandable bistable tubular.

One example of designing for certain desired results is an expandable bistable tubular string with more than one diameter throughout the length of the string. This can be useful in boreholes with varying diameters, whether designed that way or as a result of unplanned occurrences such as formation washouts or keyseats within the borehole. This also can be beneficial when it is desired to have a portion of the bistable expandable device located inside a cased section of the well while another portion is located in an uncased section of the well. FIG. 11 illustrates one example of this condition. A wellbore 40 is drilled from the surface 42 and comprises a cased section 44 and an openhole section 46. An expandable bistable device 48 having segments 50, 52 with various diameters is placed in the well. The segment with a larger diameter 50 is used to stabilize the openhole section 46 of the well, while the segment having a reduced diameter 52 is located inside the cased section 44 of the well.

Bistable collars or connectors 24A (see FIG. 4C) can be designed to allow sections of the bistable expandable tubular to be joined together into a string of useful lengths using the same principle as illustrated in FIG. 4A and 4B. This bistable connector 24A also incorporates a bistable cell design that allows it to expand radially using the same mechanism as for the bistable expandable tubular component. Exemplary bistable connectors have a diameter slightly larger than the expandable tubular sections that are being joined. The bistable connector is then placed over the ends of the two sections and mechanically attached to the expandable tubular sections. Mechanical fasteners such as screws, rivets or bands can be used to connect the connector to the tubular sections. The bistable connector typically is designed to have an expansion rate that is compatible with the expandable tubular sections, so that it continues to connect the two sections after the expansion of the two segments and the connector.

Alternatively, the bistable connector can have a diameter smaller than the two expandable tubular sections joined. Then, the connector is inserted inside of the ends of the tubulars and mechanically fastened as discussed above. Another embodiment would involve the machining of the ends of the tubular sections on either their inner or outer surfaces to form an annular recess in which the connector is located. A connector designed to fit into the recess is placed in the recess. The connector would then be mechanically attached to the ends as described above. In this way the connector forms a relatively flush-type connection with the tubular sections.

A conveyance device 31 transports the bistable expandable tubular lengths and bistable connectors into the wellbore and to the correct position. (See FIGS. 4C and 4D). The conveyance device may utilize one or more mechanisms such as wireline cable, coiled tubing, coiled tubing with wireline conductor, drill pipe, tubing or casing.

A deployment device 33 can be incorporated into the overall assembly to expand the bistable expandable tubular and connectors. (See FIGS. 4C and 4D). Deployment devices can be of numerous types such as an inflatable packer element, a mechanical packer element, an expandable swage, a piston apparatus, a mechanical actuator, an electrical solenoid, a plug type apparatus, e.g. a conically shaped device pulled or pushed through the tubing, a ball type apparatus or a rotary type expander as further discussed below.

Figure 5A:
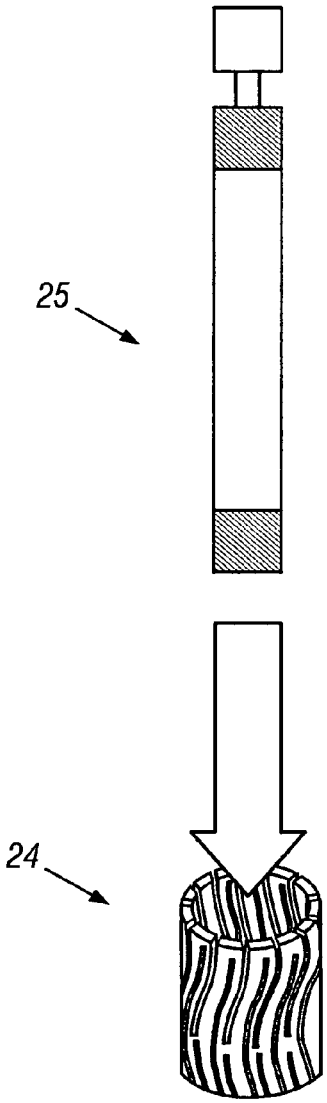
FIGS. 5A and 5B illustrate an expandable packer type of deployment device.
Figure 5B:
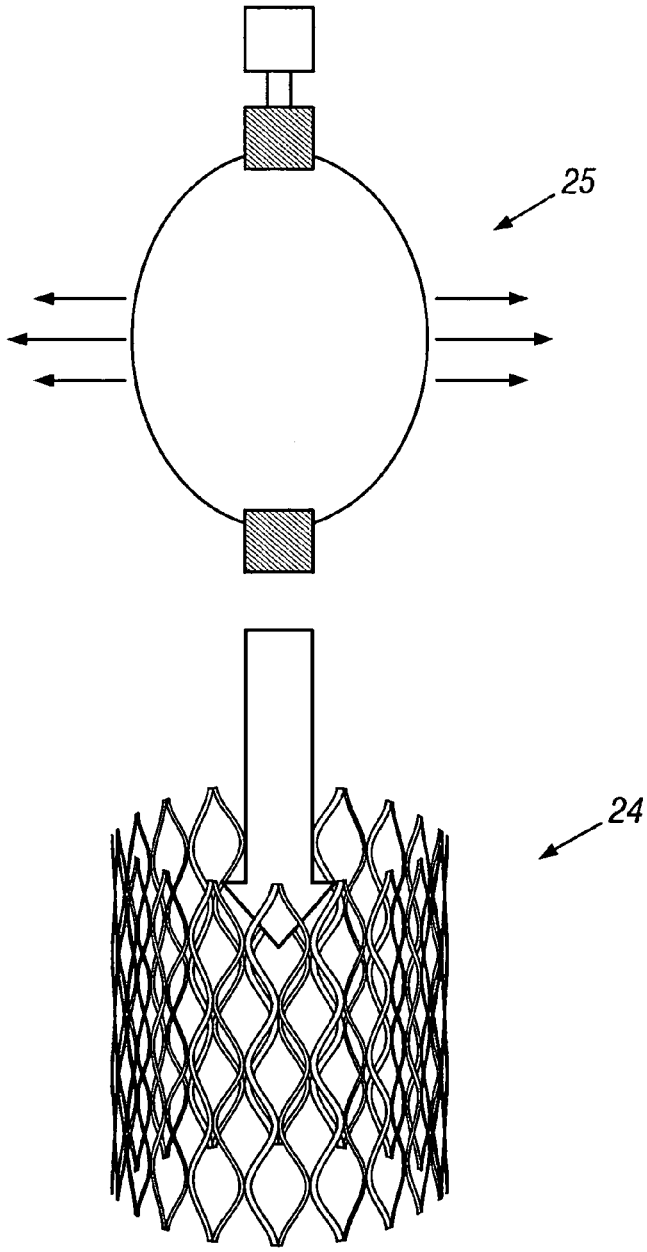

An inflatable packer element is shown in FIGS. 5A and 5B and is a device with an inflatable bladder, element, or bellows incorporated into the bistable expandable tubular system bottom hole assembly. In the illustration of FIG. 5A, the inflatable packer element 25 is located inside the entire length, or a portion, of the initial collapsed state bistable tubular 24 and any bistable expandable connectors (not shown). Once the bistable expandable tubular system is at the correct deployment depth, the inflatable packer element 25 is expanded radially by pumping fluid into the device as shown in FIG. 5B. The inflation fluid can be pumped from the surface through tubing or drill pipe, a mechanical pump, or via a downhole electrical pump which is powered via wireline cable. As the inflatable packer element 25 expands, it forces the bistable expandable tubular 24 to also expand radially. At a certain expansion diameter, the inflatable packer element causes the bistable cells in the tubular to reach a critical geometry where the bistable "snap" effect is initiated, and the bistable expandable tubular system expands to its final diameter. Finally the inflatable packer element 25 is deflated and removed from the deployed bistable expandable tubular 24.

Figure 6A:
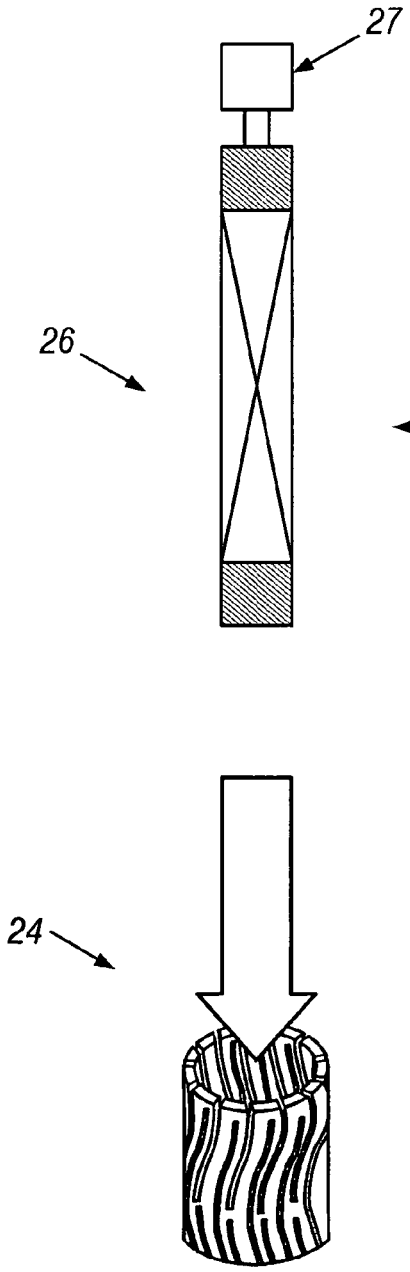
FIGS. 6A and 6B illustrate a mechanical packer type of deployment device.
Figure 6B:
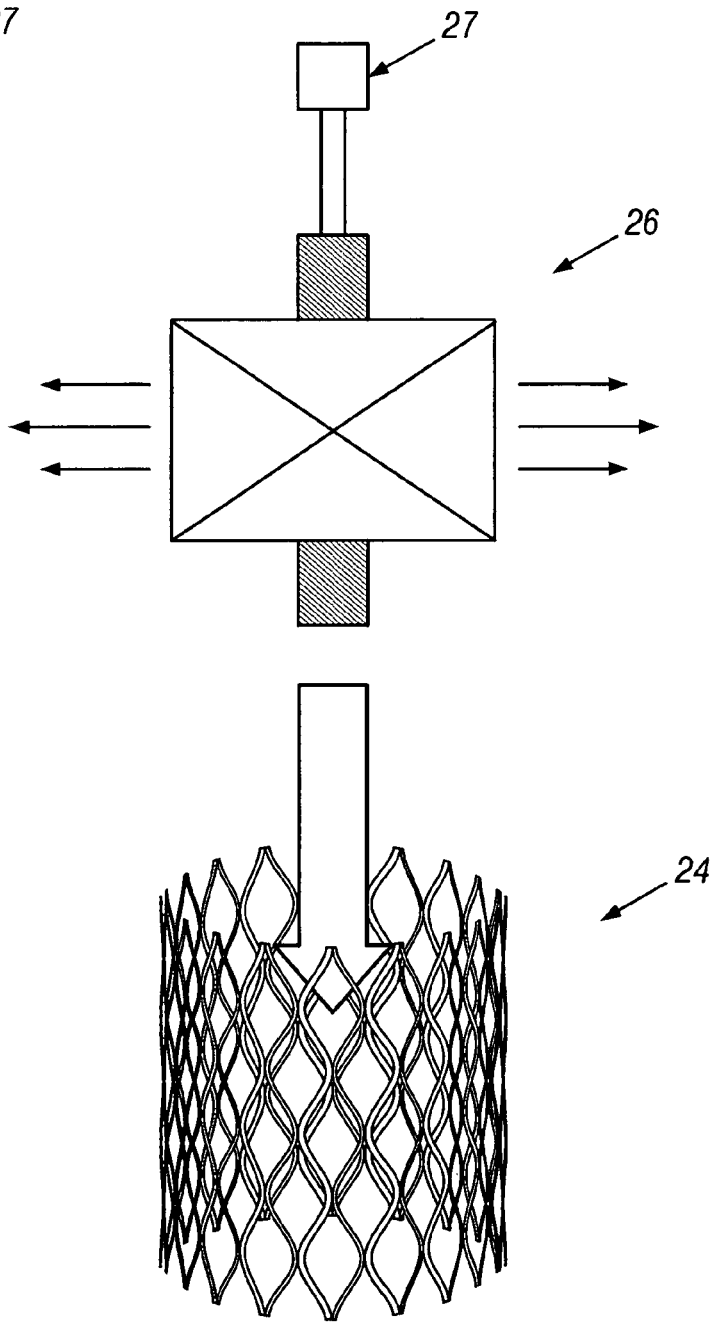

A mechanical packer element is shown in FIGS. 6A and 6B and is a device with a deformable plastic element 26 that expands radially when compressed in the axial direction. The force to compress the element can be provided through a compression mechanism 27, such as a screw mechanism, cam, or a hydraulic piston. The mechanical packer element deploys the bistable expandable tubulars and connectors in the same way as the inflatable packer element. The deformable plastic element 26 applies an outward radial force to the inner circumference of the bistable expandable tubulars and connectors, allowing them in turn to expand from a contracted position (see FIG. 6A) to a final deployment diameter (see FIG. 6B).

Figure 7A:
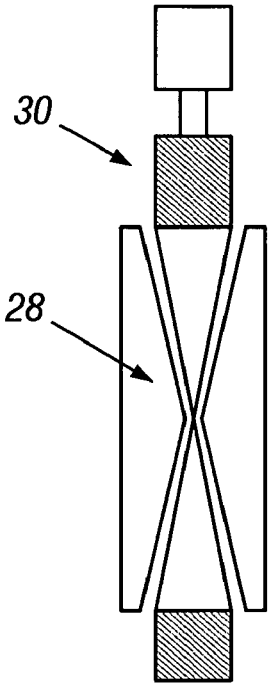
FIGS. 7A–7D illustrate an expandable swage type of deployment device.
Figure 7B:
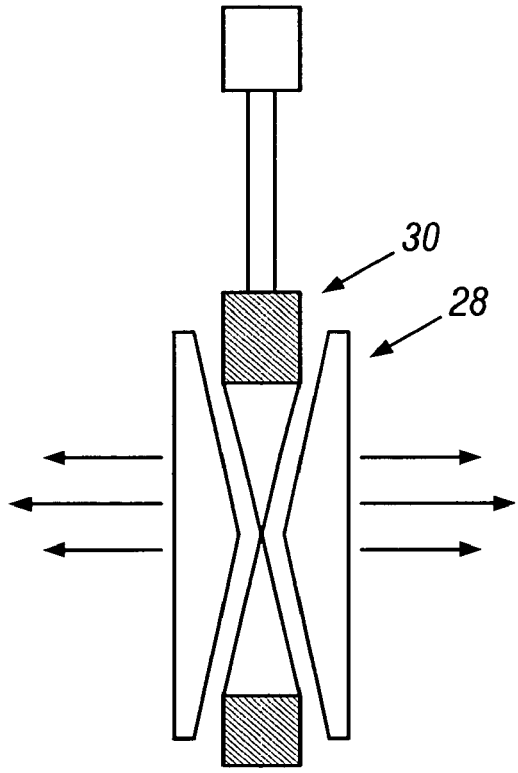
Figure 7C:
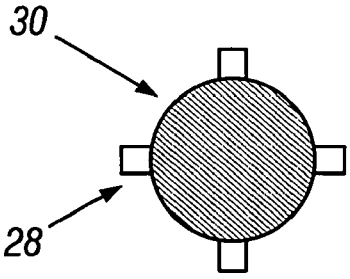
Figure 7D:
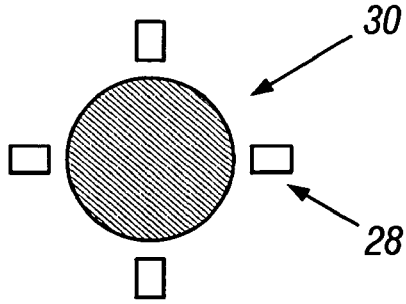

An expandable swage is shown in FIGS. 7A–7D and comprises a series of fingers 28 that are arranged radially around a conical mandrel 30. FIGS. 7A and 7C show side and top views respectively. When the mandrel 30 is pushed or pulled through the fingers 28 they expand radially outwards, as illustrated in FIGS. 7B and 7D. An expandable swage is used in the same manner as a mechanical packer element to deploy a bistable expandable tubular and connector.

Figure 8A:
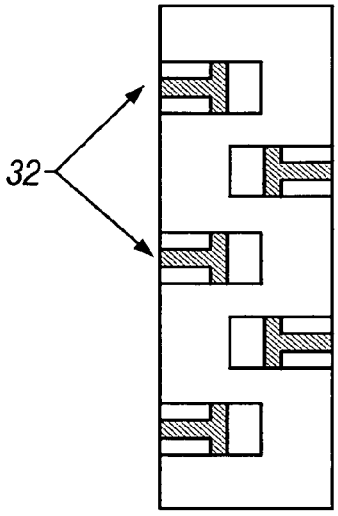
FIGS. 8A–8D illustrate a piston type of deployment device.
Figure 8B:
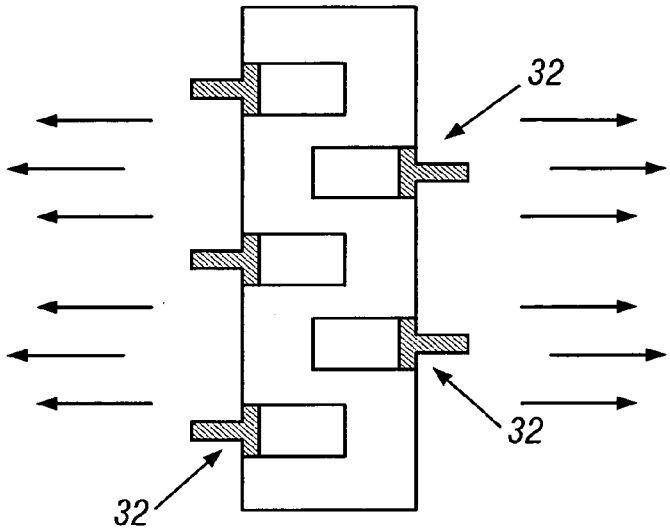
Figure 8C:
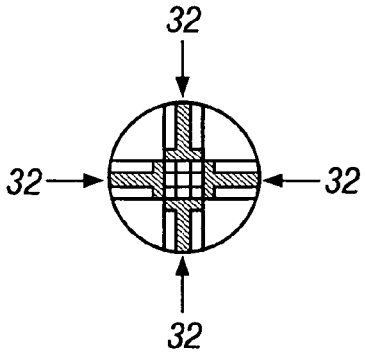
Figure 8D:
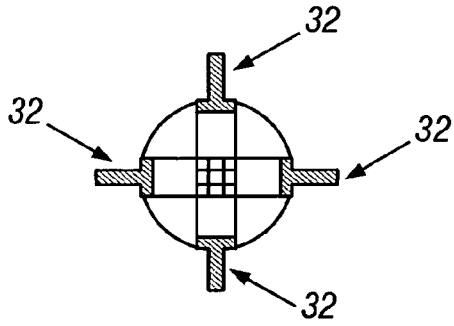

A piston type apparatus is shown in FIGS. 8A–8D and comprises a series of pistons 32 facing radially outwardly and used as a mechanism to expand the bistable expandable tubulars and connectors. When energized, the pistons 32 apply a radially directed force to deploy the bistable expandable tubular assembly as per the inflatable packer element. FIGS. 8A and 8C illustrate the pistons retracted while FIGS. 8B and 8D show the pistons extended. The piston type apparatus can be actuated hydraulically, mechanically or electrically.

Figure 9A:
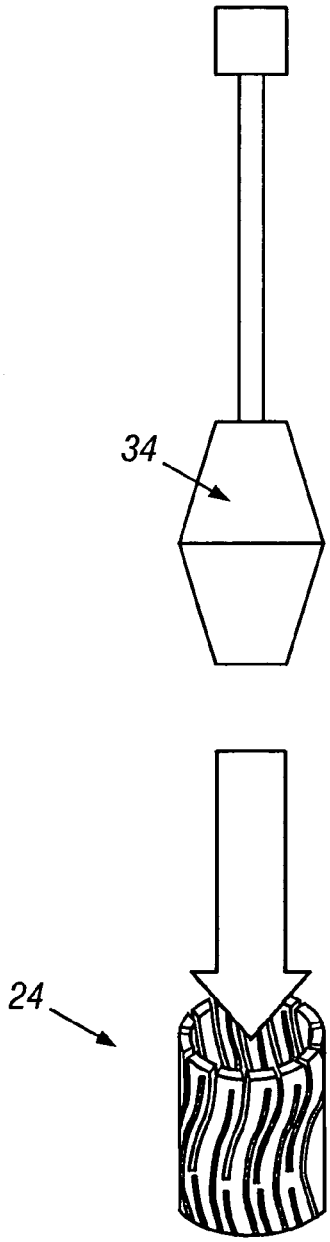
FIGS. 9A and 9B illustrate a plug type of deployment device.
Figure 9B:
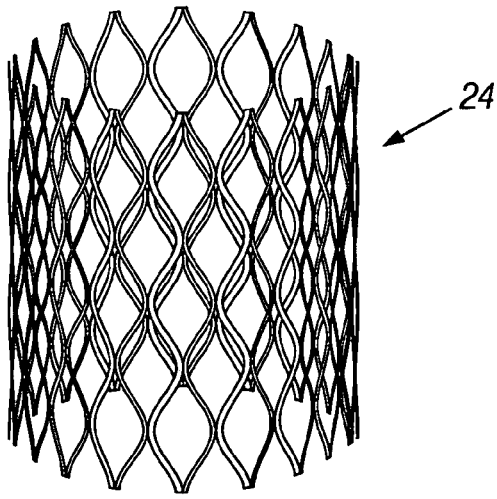

A plug type actuator is illustrated in FIGS. 9A and 9B and comprises a plug 34 that is pushed or pulled through the bistable expandable tubulars 24 or connectors as shown in FIG. 9A. The plug is sized to expand the bistable cells past their critical point where they will snap to a final expanded diameter as shown in FIG. 9B.

Figure 10A:
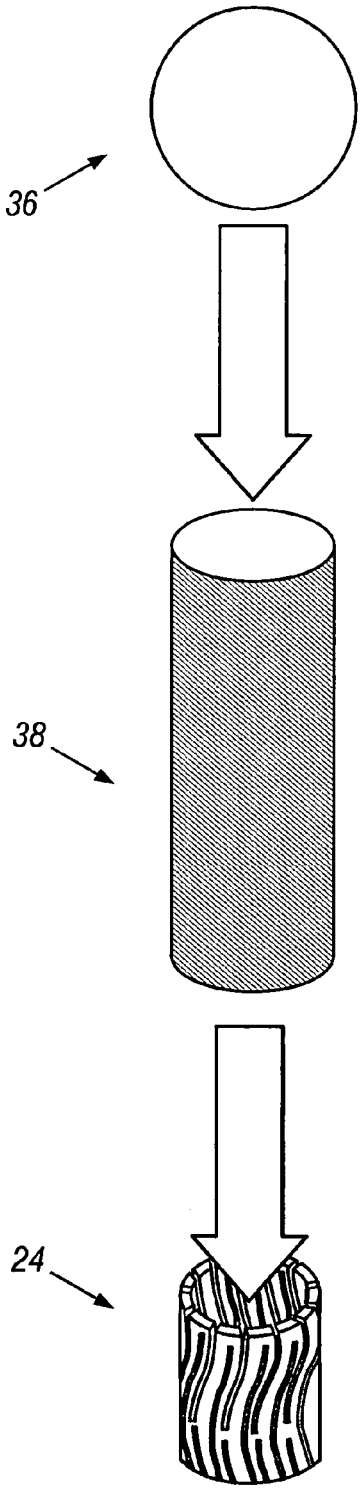
FIGS. 10A and 10B illustrate a ball type of deployment device.
Figure 10B:
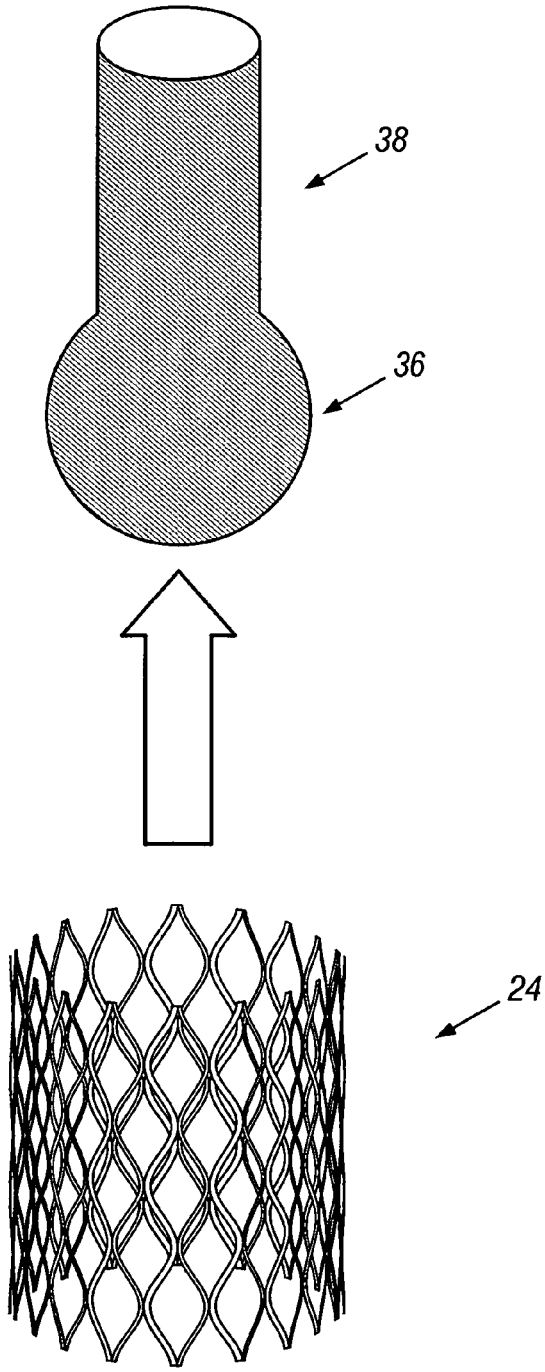

A ball type actuator is shown in FIGS. 10A and 10B and operates when an oversized ball 36 is pumped through the middle of the bistable expandable tubulars 24 and connectors. To prevent fluid losses through the cell slots, an expandable elastomer based liner 38 is run inside the bistable expandable tubular system. The liner 38 acts as a seal and allows the ball 36 to be hydraulically pumped through the bistable tubular 24 and connectors. The effect of pumping the ball 36 through the bistable expandable tubulars 24 and connectors is to expand the cell geometry beyond the critical bistable point, allowing full expansion to take place as shown in FIG. 10B. Once the bistable expandable tubulars and connectors are expanded, the elastomer sleeve 38 and ball 36 are withdrawn.

Figure 12:
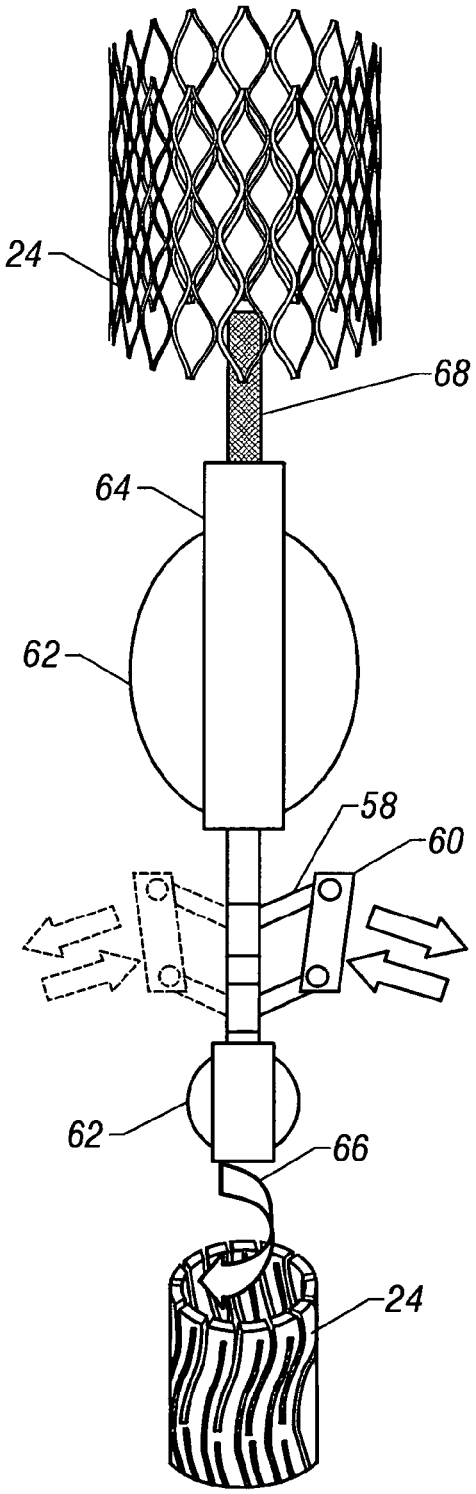
FIG. 12 illustrates a motor driven radial roller deployment device.

Radial roller type actuators also can be used to expand the bistable tubular sections. FIG. 12 illustrates a motor driven expandable radial roller tool. The tool comprises one or more sets of arms 58 that are expanded to a set diameter by means of a mechanism and pivot. On the end of each set of arms is a roller 60. Centralizers 62 can be attached to the tool to locate it correctly inside the wellbore and the bistable tubular 24. A motor 64 provides the force to rotate the whole assembly, thus turning the roller(s) circumferentially inside the wellbore. The axis of the roller(s) is such as to allow the roller(s) to rotate freely when brought into contact with the inner surface of the tubular. Each roller can be conically-shaped in section to increase the contact area of roller surface to the inner wall of the tubular. The rollers are initially retracted and the tool is run inside the collapsed bistable tubular. The tool is then rotated by the motor 64, and rollers 60 are moved outwardly to contact the inner surface of the bistable tubular. Once in contact with the tubular, the rollers are pivoted outwardly a greater distance to apply an outwardly radial force to the bistable tubular. The outward movement of the rollers can be accomplished via centrifugal force or an appropriate actuator mechanism coupled between the motor 64 and the rollers 60.

The final pivot position is adjusted to a point where the bistable tubular can be expanded to the final diameter. The tool is then longitudinally moved through the collapsed bistable tubular, while the motor continues to rotate the pivot arms and rollers. The rollers follow a shallow helical path 66 inside the bistable tubular, expanding the bistable cells in their path. Once the bistable tubular is deployed, the tool rotation is stopped and the roller retracted. The tool is then withdrawn from the bistable tubular by a conveyance device 68 that also can be used to insert the tool.

Figure 13:
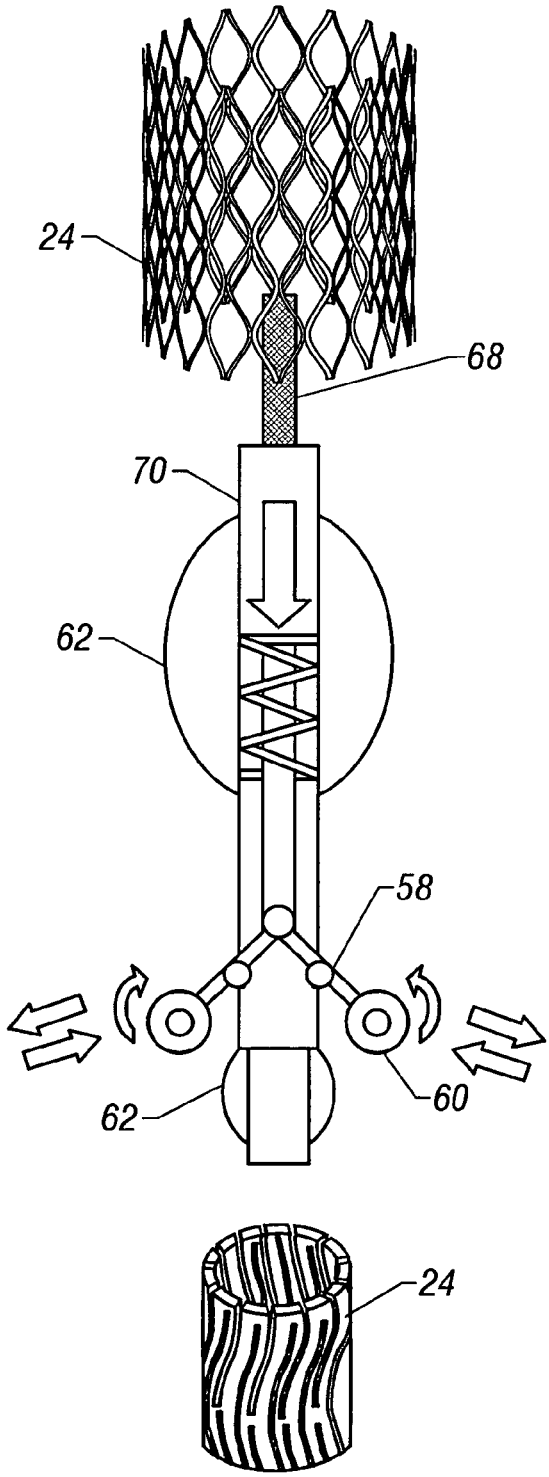
FIG. 13 illustrates a hydraulically driven radial roller deployment device.

FIG. 13 illustrates a hydraulically driven radial roller deployment device. The tool comprises one or more rollers 60 that are brought into contact with the inner surface of the bistable tubular by means of a hydraulic piston 70. The outward radial force applied by the rollers can be increased to a point where the bistable tubular expands to its final diameter. Centralizers 62 can be attached to the tool to locate it correctly inside the wellbore and bistable tubular 24. The rollers 60 are initially retracted and the tool is run into the collapsed bistable tubular 24. The rollers 60 are then deployed and push against the inside wall of the bistable tubular 24 to expand a portion of the tubular to its final diameter. The entire tool is then pushed or pulled longitudinally through the bistable tubular 24 expanding the entire length of bistable cells 23. Once the bistable tubular 24 is deployed in its expanded state, the rollers 60 are retracted and the tool is withdrawn from the wellbore by the conveyance device 68 used to insert it. By altering the axis of the rollers 60, the tool can be rotated via a motor as it travels longitudinally through the bistable tubular 24.

Power to operate the deployment device can be drawn from one or a combination of sources such as: electrical power supplied either from the surface or stored in a battery arrangement along with the deployment device, hydraulic power provided by surface or downhole pumps, turbines or a fluid accumulator, and mechanical power supplied through an appropriate linkage actuated by movement applied at the surface or stored downhole such as in a spring mechanism.

The bistable expandable tubular system is designed so the internal diameter of the deployed tubular is expanded to maintain a maximum cross-sectional area along the expandable tubular. This feature enables mono-bore wells to be constructed and facilitates elimination of problems associated with traditional wellbore casing systems where the casing outside diameter must be stepped down many times, restricting access, in long wellbores.

The bistable expandable tubular system can be applied in numerous applications such as an expandable open hole liner where the bistable expandable tubular 24 is used to support an open hole formation by exerting an external radial force on the wellbore surface. As bistable tubular 24 is radially expanded, the tubular moves into contact with the surface forming wellbore 29. These radial forces help stabilize the formations and allow the drilling of wells with fewer conventional casing strings. The open hole liner also can comprise a material, e.g. a wrapping, that reduces the rate of fluid loss from the wellbore into the formations. The wrapping can be made from a variety of materials including expandable metallic and/or elastomeric materials. By reducing fluid loss into the formations, the expense of drilling fluids can be reduced and the risk of losing circulation and/or borehole collapse can be minimized.

Liners also can be used within wellbore tubulars for purposes such as corrosion protection. One example of a corrosive environment is the environment that results when carbon dioxide is used to enhance oil recovery from a producing formation. Carbon dioxide ($CO_2$) readily reacts with any water ($H_2O$) that is present to form carbonic acid ($H_2CO_3$). Other acids can also be generated, especially if sulfur compounds are present. Tubulars used to inject the carbon dioxide as well as those used in producing wells are subject to greatly elevated corrosion rates. The present invention can be used to place protective liners, e.g. a bistable tubular 24, within an existing tubular to minimize the corrosive effects and to extend the useful life of the wellbore tubulars.

Another exemplary application involves use of the bistable tubular 24 as an expandable perforated liner. The open bistable cells in the bistable expandable tubular allow unrestricted flow from the formation while providing a structure to stabilize the borehole.

Still another application of the bistable tubular 24 is as an expandable sand screen where the bistable cells are sized to act as a sand control screen. Also, a filter material can be combined with the bistable tubular as explained below. For example, an expandable screen element can be affixed to the bistable expandable tubular. The expandable screen element can be formed as a wrapping around bistable tubular 24. It has been found that the imposition of hoop stress forces onto the wall of a borehole will in itself help stabilize the formation and reduce or eliminate the influx of sand from the producing zones, even if no additional screen element is used.

The above described bistable expandable tubulars can be made in a variety of manners such as: cutting appropriately shaped paths through the wall of a tubular pipe thereby creating an expandable bistable device in its collapsed state; cutting patterns into a tubular pipe thereby creating an expandable bistable device in its expanded state and then compressing the device into its collapsed state; cutting appropriate paths through a sheet of material, rolling the material into a tubular shape and joining the ends to form an expandable bistable device in its collapsed state; or cutting patterns into a sheet of material, rolling the material into a tubular shape, joining the adjoining ends to form an expandable bistable device in its expanded state and then compressing the device into its collapsed state.

The materials of construction for the bistable expandable tubulars can include those typically used within the oil and gas industry such as carbon steel. They can also be made of specialty alloys (such as a monel, inconel, hastelloy or tungsten-based alloys) if the application requires.

The configurations shown for the bistable tubular 24 are illustrative of the operation of a basic bistable cell. Other configurations may be suitable, but the concept presented is also valid for these other geometries.

In FIGS. 14 through 20, an exemplary particulate screen 80, e.g. sand screen, is illustrated as formed of a tubular made of bistable cells. The sand screen 80 has a tubular 82, formed of bistable cells 23 as previously discussed, that provides the structure to support a filter material 84 as well as the necessary inflow openings through the base tubular that are a part of the bistable cell 23 construction. The sand screen 80 has at least one filter 84 (or filter material) along at least a portion of its length. The filter 84 may be formed of a material commonly used for sand screens and may be designed for the specific requirements of the particular application (e.g., the mesh size, number of layers, material used, etc.). Further, the properties and design of the filter 84 allow it to at least match the expansion ratio of the tubular 82. Folds, multiple overlapping layers, or other design characteristics of the filter 84 may be used to facilitate the expansion. The sand screen 80 could be expanded as described herein and may include any form of bistable cell. In one embodiment of use, the sand screen 80 is deployed on a run-in tool that includes an expanding tool, as described above. The sand screen 80 is positioned at the desired location (e.g., adjacent the area to be filtered) and expanded. The sand screen 80 may expand such that it engages or contacts the walls of the well conduit (such as the borehole) essentially eliminating or reducing any annulus between the sand screen and the well conduit. In such a case the need for a gravel pack may be reduced or eliminated.

Figure 14:
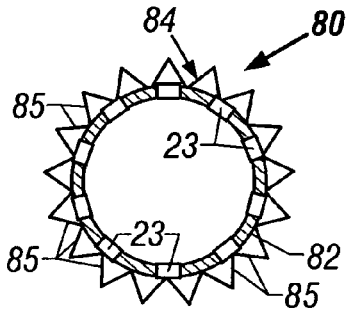
FIG. 14 is a cross-sectional view of one embodiment of the sand screen of the present invention.
Figure 15:
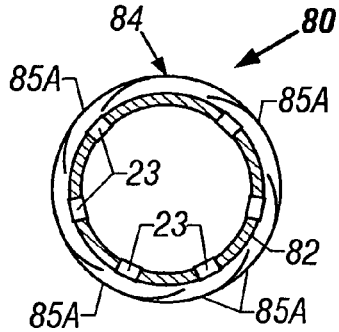
FIG. 15 is a cross-sectional view of one embodiment of the sand screen of the present invention.
Figure 16:
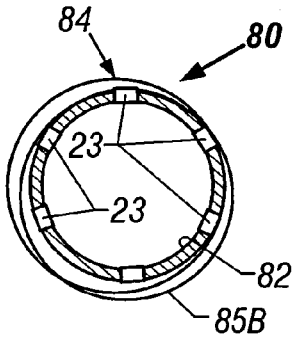
FIG. 16 is a cross-sectional view of one embodiment of the sand screen of the present invention.
Figure 17:
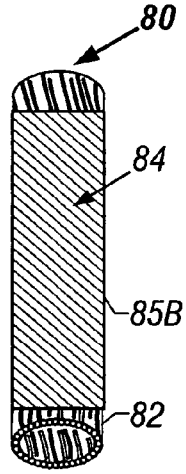
FIG. 17 is a perspective view of one embodiment of the sand screen of the present invention.

FIGS. 14 and 15 illustrate alternative embodiments of the sand screen 80 of the present invention. In the embodiment of FIG. 14, the filter material 84 has a plurality of folds 85 to allow expansion of the tubular 82. The filter material 84 is connected to the tubular 82 (as by welding or other methods) at various points about the tubular circumference. In the embodiment of FIG. 15, the filter material 84 is provided in overlapping sheets 85A which are each attached at one edge so that one sheet of material 84 has a longitudinally extending edge attached to the tubular 82 and overlaps an adjacent sheet of filter material 84. As the tubular expands, the filter sheets 85A slide over one another and still cover the full expanded circumference of the tubular 82. In the embodiment of FIGS. 16 and 17, the filter material 84 is in the form of a single sheet 85B attached to the tubular 82 in at least one longitudinal location and wrapped around the tubular 82. Single sheet 85B overlaps itself so that in the fully expanded state, the full circumference of the tubular 82 is still covered by the filter material 84.

Figure 18:
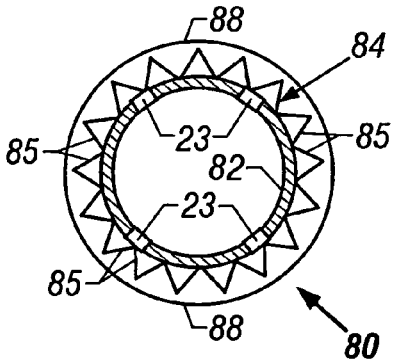
FIG. 18 is a cross-sectional view of one embodiment of the sand screen of the present invention.
Figure 19:
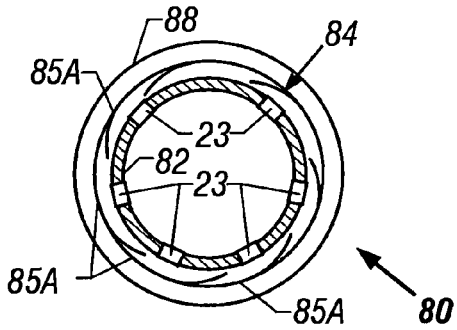
FIG. 19 is a cross-sectional view of one embodiment of the sand screen of the present invention.
Figure 20:
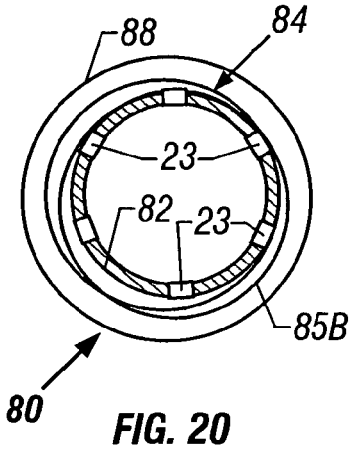
FIG. 20 is a cross-sectional view of one embodiment of the sand screen of the present invention.

As illustrated in FIGS. 18 through 20, additional alternative embodiments are similar to those of FIGS. 14 through 16 respectively but include a shroud 88. Shroud 88 encircles tubular 82 and filter 84 to protect the filter media 84 during shipping and deployment.

Figure 21:
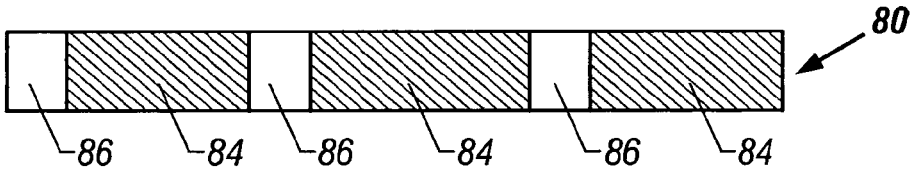
FIG. 21 is a side elevational view of a screen according to one embodiment of the present invention.

In an alternative embodiment (shown in FIG. 21), the sand screen 80 has at least one section supporting a filter 84 and at least one other section of the tubular supporting a seal material 86. In the exemplary embodiment, multiple longitudinal filter sections are separated by seal sections. The seal material 86 may comprise an elastomer or other useful seal material and has an expansion ratio at least as great as the tubular. When expanded, the seal material preferably seals against the walls of a conduit in a well (e.g., the borehole wall, the bottom end of a liner or a casing positioned in the well, etc). Providing multiple sections with filter material 84 separated by sections having a seal material 86 thereon provides isolated screen sections.

Figure 22:
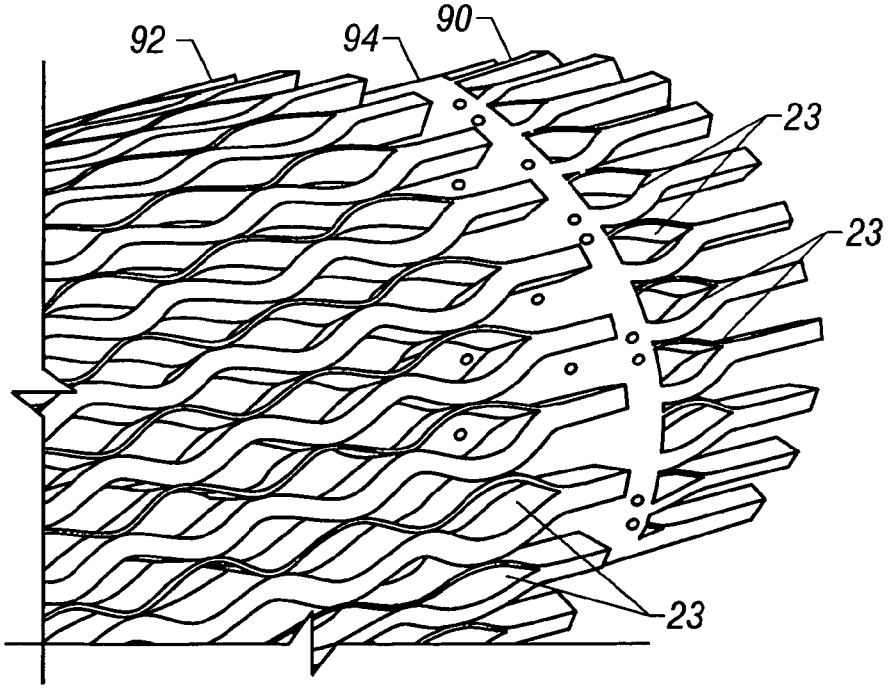
FIG. 22 is a partial perspective view of a screen according to one embodiment of the present invention.

In FIG. 22 another embodiment of the sand screen is illustrated in which at least one filter media 94 is positioned between a pair of expandable tubes 90,92. The tubes 90,92 are formed of bistable cells 23 and protect the filter media 94 from damage. The filter media 94 may be formed from a variety of filter media. The embodiment illustrated in FIG. 22 uses a relatively thin sheet of material, such as a foil material, having perforations therein.

Figure 23:
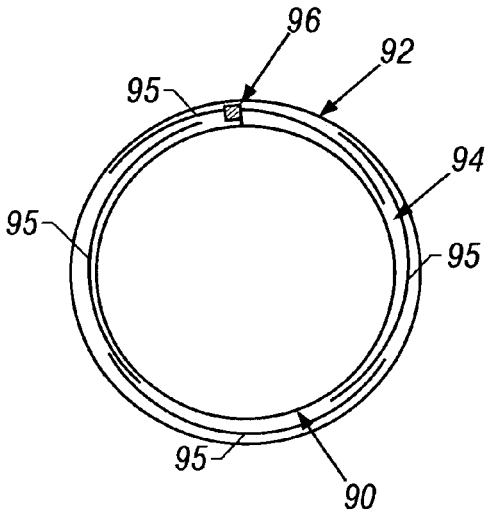
FIG. 23 is a cross-sectional schematic view of one embodiment of the present invention.
Figure 24:
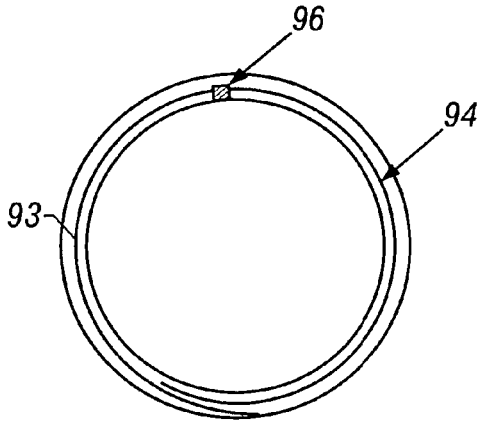
FIG. 24 is a cross-sectional schematic view of one embodiment of the present invention.

As illustrated in FIGS. 23 and 24, filter media 94 may comprise a single sheet 93 of filter media 94 (FIG. 24) or a plurality of sheets 95 of overlapping material (FIG. 23). As shown in the figures, the material may connect to one of the tubes 90,92 at a connection point 96 intermediate the edges of the filter media 94. Alternatively, the filter media 94 may connect to one of the tubes 90,92 at an edge thereof. However, connecting the filter media 94 intermediate the edge allows each edge to overlap at least an adjacent filter sheet or, in the case of a single sheet, to overlap itself. FIG. 24 illustrates edges of the filter media 94 overlapping one another. Note that the filter sheet may connect to either the base tube 90 or the outer tube 92.

Figure 25:
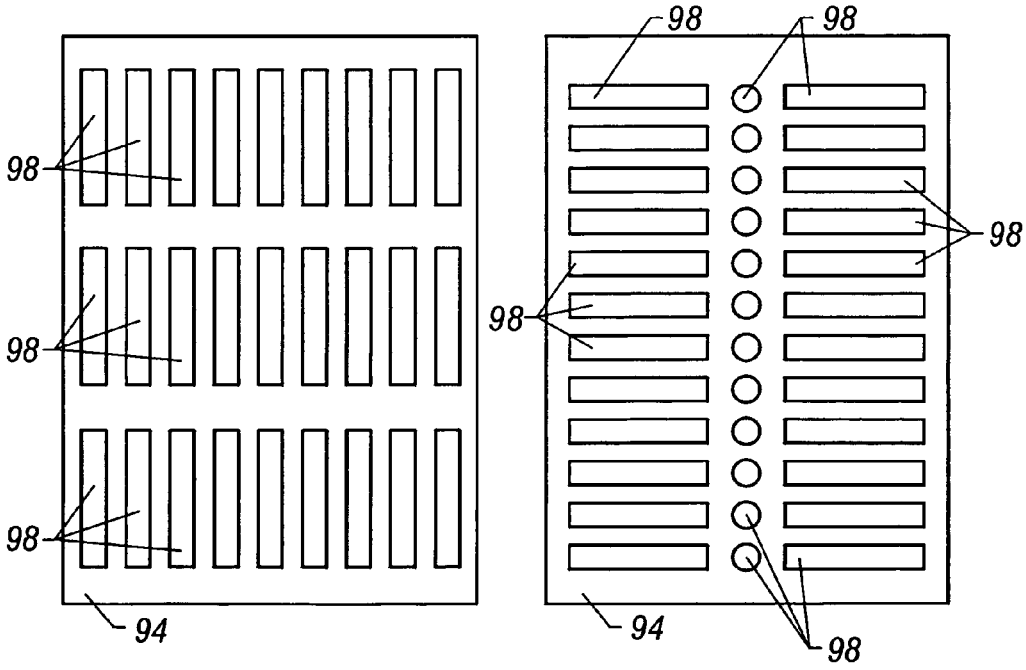
FIG. 25 is a schematic view of an embodiment of filter sheets for the present invention.

In FIG. 25, a pair of filter sheets are positioned side-by-side. The filter sheets are formed of a relatively thin material, such as a metal foil, having perforations 98 therein. The perforations may be formed in a variety of ways. One manner of forming the perforations is with laser cutting techniques; while an alternative method is to use a water jet cutting technique. In the embodiment shown, the perforations in one of the filter sheets are slots having a relatively high aspect ratio. The other filter sheet has slots and holes. The slots of the second sheet are oriented at an angle to the slots of the first filter sheet.

Figure 26:
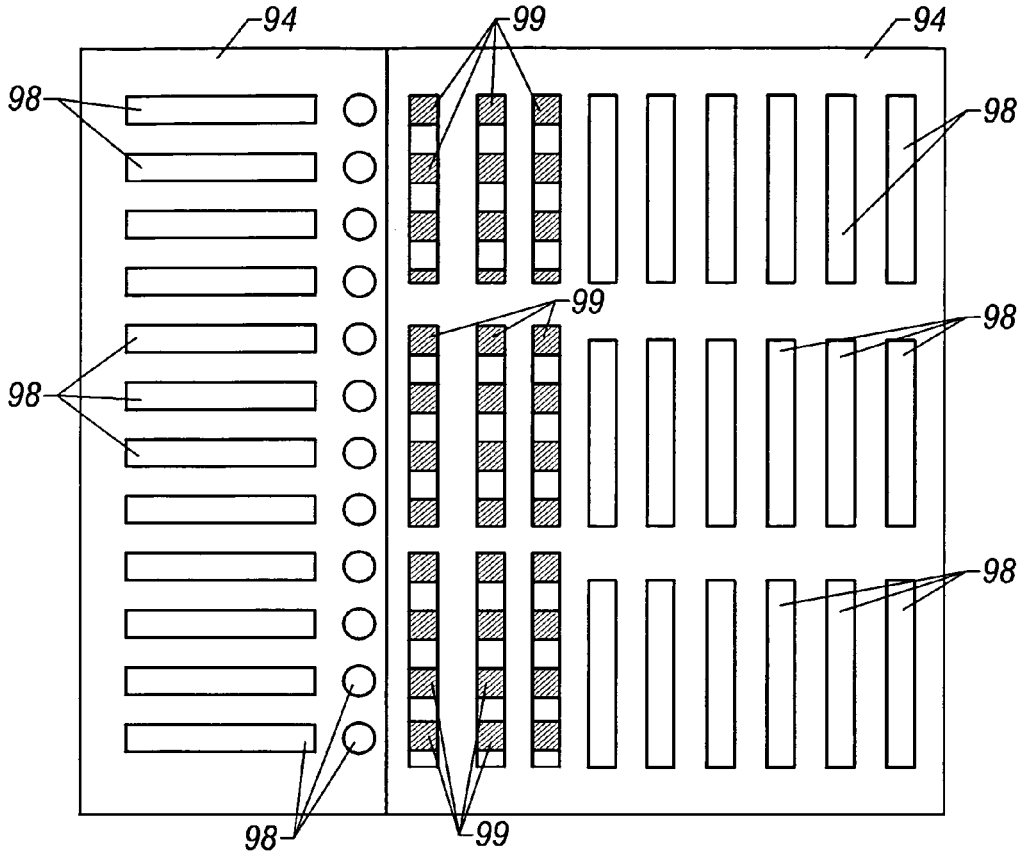
FIG. 26 is a schematic view of one embodiment of filter sheets that can be utilized with the device illustrated in FIG. 25.

In FIG. 26, the filter sheets are illustrated as overlapping one another to create a flow area 99 through the overlapping filter sheets, due to the relative orientation of the perforations 98. Note that the perforations 98 may have a variety of shapes depending on the needs of the particular application. Also, the amount of overlap and relative positioning and shape of the perforations may be used to provide a desired flow path characteristic and flow path regime. For example, the relative pressure drop through the screen about the circumference or length of the screen may be predesigned by selecting the desired flow path sizes and pattern overlap. Providing a pressure drop that varies along the length of the sand screen, as an example, may provide for a more uniform production boundary layer control and help reduce coning during production. As an example, a portion of the sand screen may provide for more restricted flow relative to another portion of the sand screen to control the boundary layer approach to the wellbore, thereby reducing coning and increasing production.

Although shown as vertical and horizontal slots, the slots may be oriented at any angle relative to the longitudinal direction of the sand screen. For example, orienting the slots at forty-five degrees to the longitudinal direction may provide greater manufacturing efficiency because the alternate sheets may be mounted so that the resulting pattern has slots of adjacent sheets oriented at ninety degrees to one another. Similarly, rounded perforations may be used to reduce flat surfaces that may tend to hang during expansion or for other reasons. The possible shapes that may be used is virtually unlimited and are selected depending upon the application. As the filter sheets slide over one another during the expansion of the tubings 90, 92, the sizes of the openings formed by the overlap of the adjacent filter sheets changes. More than two filter sheets 94 may overlap one another so that, for example, at least a portion of the filtering media may comprise three or more layers of filter sheets.

Figure 27:
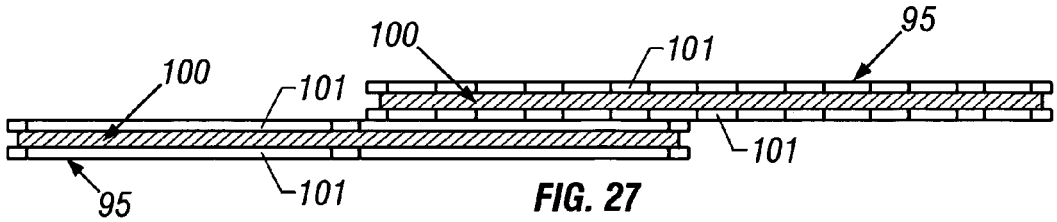
FIG. 27 is a partial cross-sectional view of an exemplary filter layer.
Figure 28:
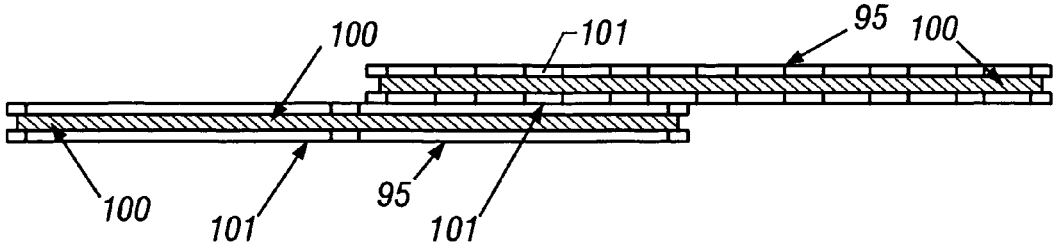
FIG. 28 is a partial cross-sectional view of another exemplary filter layer.

In FIGS. 27 and 28, alternative embodiments for the composition of the filter sheets, e.g. sheets 95, are illustrated. The embodiment illustrated in FIG. 27 uses filter sheets having a central filter portion 100 formed of a compact fibrous metal material (e.g., a free-wire mesh). The material forms multiple tortuous paths sandwiched between a pair of foil sheets 101. In the embodiment of FIG. 28, central filter portion 100 has a woven-type material, such as a woven Dutch twill filter material, positioned between a pair of foil sheets 101. Other filter media also may be used.

Figure 29A:
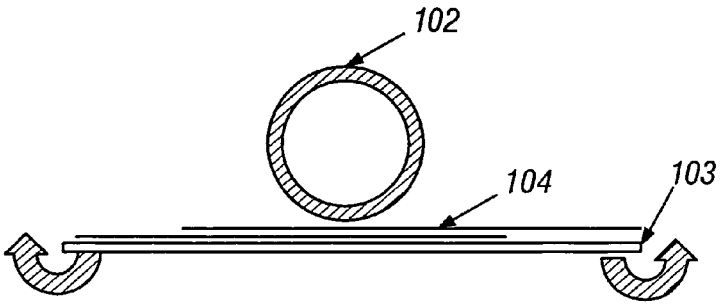
FIGS. 29A–B are cross-sectional views illustrating an exemplary technique for screen formation.
Figure 29B:
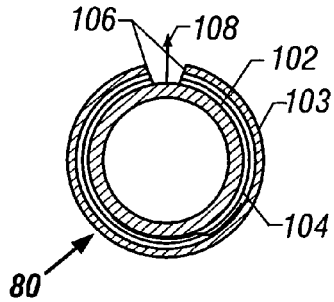

With reference to FIGS. 29A–B, an exemplary technique for manufacturing an expandable sand screen 80 can be described. Note that the manufacturing technique may be used to manufacture other expandable systems having multiple layers of expandable conduits. Likewise, this manufacturing technique may be used to manufacture non-expanding sand screens and similar equipment. As shown in the figure, an inner conduit 102 is positioned on a plate 103 having a layer of filter material 104 positioned thereon. Filter material 104 is positioned to reside between the plate 103 and the inner conduit 102. In the case of an expandable system, the inner conduit 102 and the plate 103 have the slots or bistable cells formed thereon prior to assembly as follows. With the conduit 102 positioned on or over the plate 103 and with the filter material 104 interposed therebetween, the plate and filter sheets are wrapped around the inner conduit 102 to the position shown in FIG. 29B. The filter sheet may cover all or some portion of the plate 103. Similarly, the filter sheet may cover all or some portion of the inner conduit 102 after wrapping.

In the embodiment shown in FIG. 29B, the plate 103 (also referred to herein as the shroud) does not extend about the full circumference of the conduit 102 leaving a gap or passageway 108 extending longitudinally along the screen 80. In other embodiments, the filter material and/or the shroud extend about the full circumference. Control lines, other types of conduits and equipment may be placed in the passageway 108. The filter material 104 may be attached to the shroud prior to wrapping such as by welding. In an alternative embodiment, the filter media 104 is attached after wrapping along with the shroud/plate 103. The filter media 104 may extend beyond the shroud for connection to the conduit 102 or in other manners as deemed convenient or advantageous depending on the design of the screen, the presence or absence of the passageway 108 and other design factors.

The screen 80 of FIGS. 29A–B may be formed of bistable cells or of other expandable devices such as overlapping longitudinal slots or corrugated tubing. In the case of an expandable tubing formed of bistable cells, for example, the welds used for attaching the various components may be placed on thick struts 22. The thick struts may be adapted so that they do not undergo deformation during expansion to preserve the integrity of the weld.

In alternative embodiments, sand screen 80 is manufactured or formed in other ways. However, shroud 103 can still be formed to extend only partially about the circumference of the conduit 102, thereby forming passageway 108. The passageway size may be adjusted as desired to route control lines, form alternate path conduits or for placement of equipment, such as monitoring devices or other intelligent completion equipment.

Figure 30:
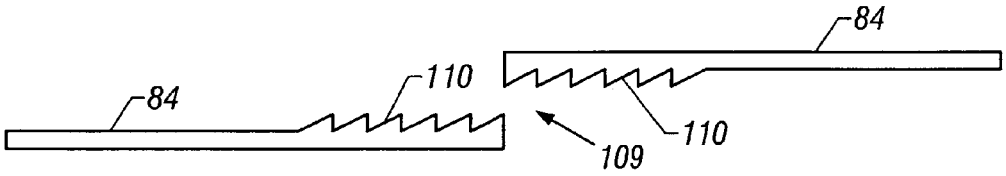
FIG. 30 is a partial cross-sectional view of a screen locking mechanism as part of one embodiment of the present invention.
Figure 31:
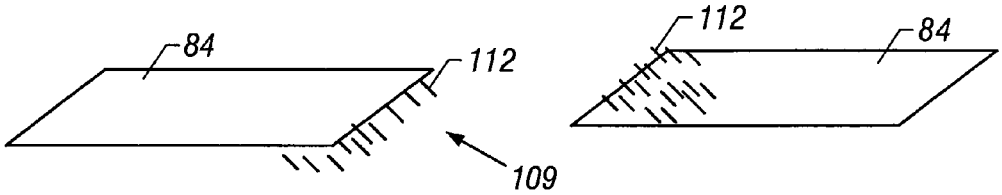
FIG. 31 is a partial cross-sectional view of an alternative screen locking mechanism.
Figure 32:
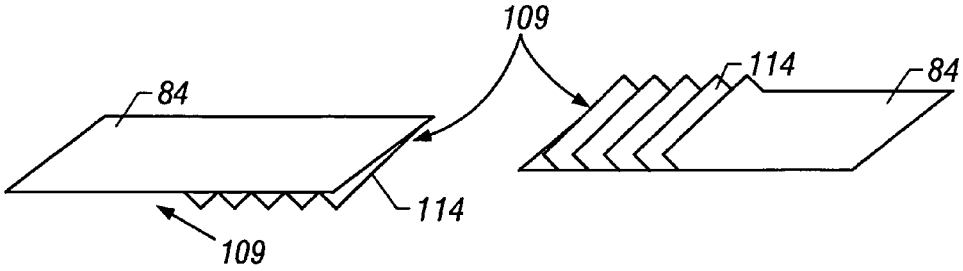
FIG. 32 is a partial cross-sectional view of another alternative screen locking mechanism.

Referring generally to FIGS. 30–32, an alternative embodiment is illustrated in which the filter material 84 includes a locking feature 109. As previously discussed, certain embodiments use one or more overlapping sheets of filter material 84 that slide over one another during expansion. In some circumstances it is advantageous to lock the filter material and the sand screen 80 in the expanded position. In the embodiments of FIGS. 30–32, the locking feature 109 allows the filter sheets 84 to slide over one another in a first direction (the expanding direction) and prevents movement in a contracting direction. The alternative embodiments shown, as examples, are ratchet teeth 110 (FIG. 30), detents or bristles 112 (FIG. 31), and vanes 114 (FIG. 32) formed on or attached to the filter media. Locking of the filter media 84 in the expanded position can be used to improve the collapse resistance of the expanded sand screen 80.

Figure 33:
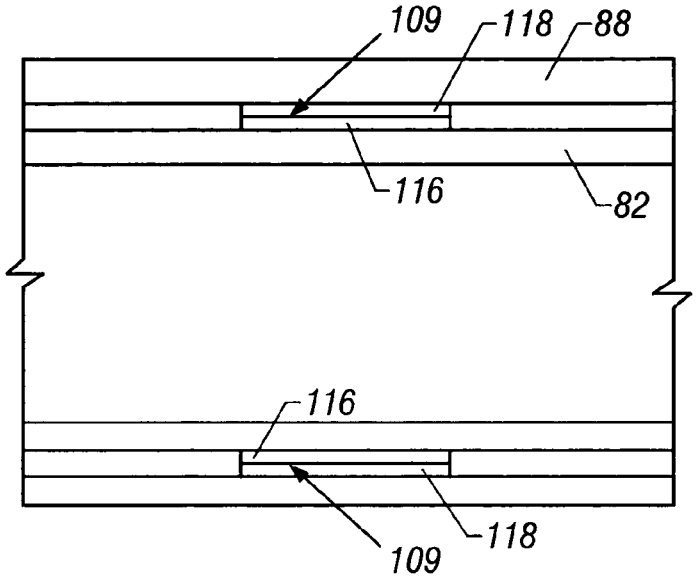
FIG. 33 is a partial cross-sectional view of a screen utilizing a locking mechanism.

In FIG. 33, another type of locking mechanism 109 is incorporated onto a portion of an expandable conduit. In this embodiment, the expandable conduit is formed of an inner tubular 82 having a portion 116 of the locking mechanism 109 (such as one of the embodiments shown in FIGS. 30–32) formed thereon. A shroud 88 surrounding the tubular 82 also has a portion 118 of the locking mechanism 109 formed thereon. As the tubular and shroud are expanded, the locking mechanism 109 locks the expanded position of the expandable conduit. A filter media may be placed between the tubular and the shroud, for example, on either side of the locking mechanism 109. The locking mechanism may be positioned about the full circumference of the tubular 82 and the shroud 88 or about a portion of the circumference.

Figure 34:
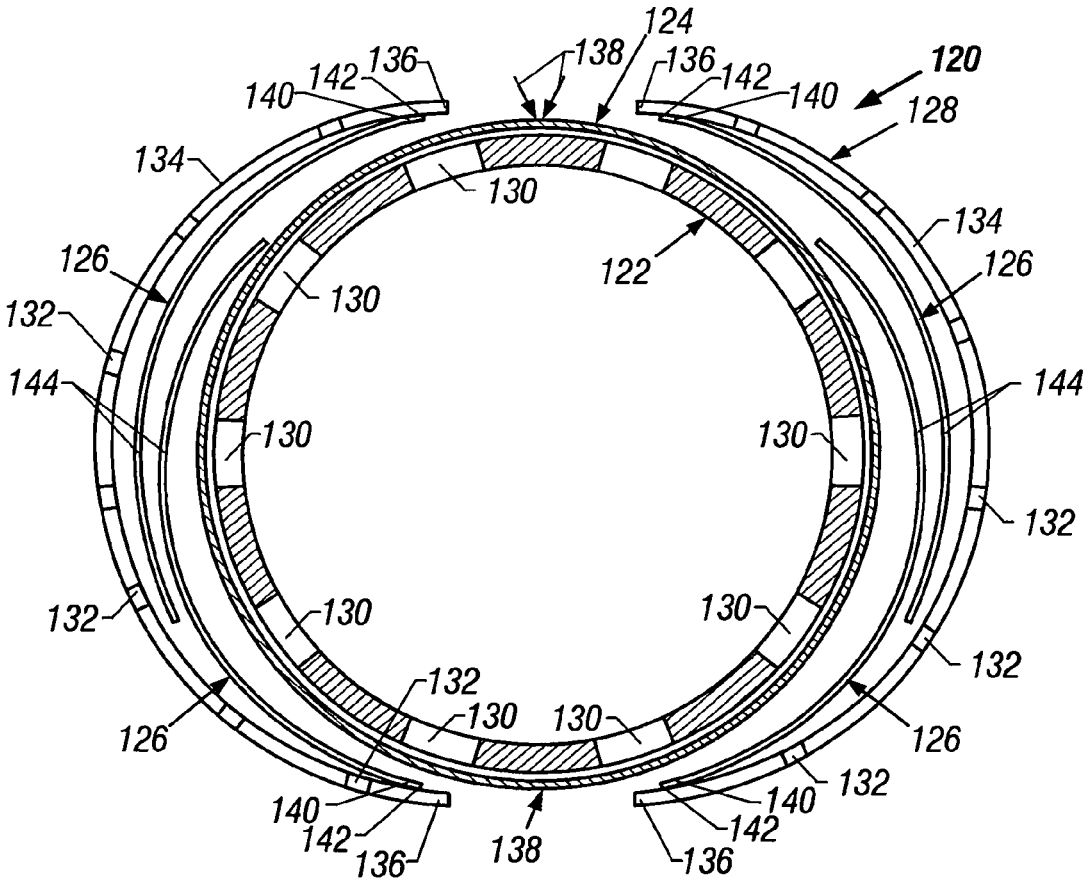
FIG. 34 is a cross-sectional, exploded view of an alternate screen according to another embodiment of the present invention.
Figure 35:
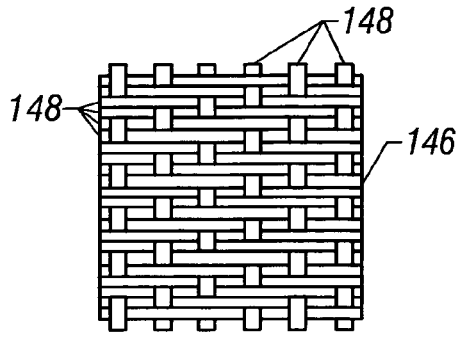
FIG. 35 is a front view of a portion of exemplary filter material for use with the embodiment illustrated in FIG. 34.
Figure 36:
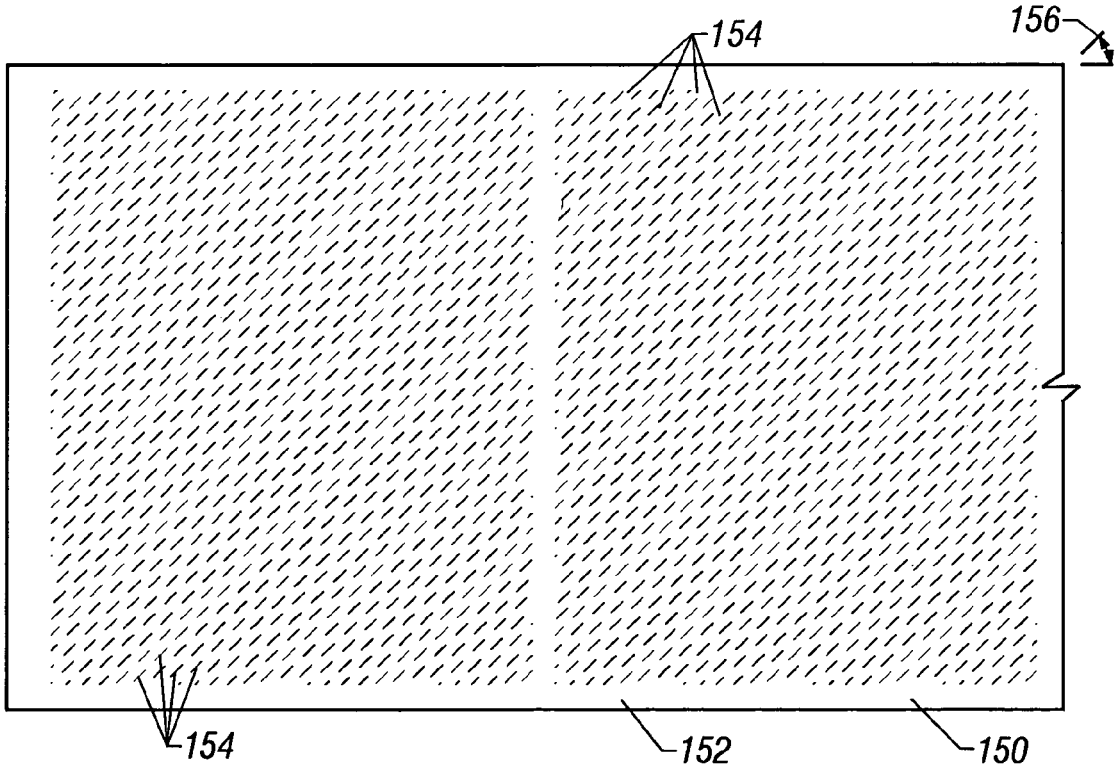
FIG. 36 is a front view of an exemplary filter sheet for use with screens, such as the screen illustrated in FIG. 34.

Referring generally to FIGS. 34 through 36, another embodiment of a particulate screen is illustrated and labeled as particulate screen 120. Particulate screen 120 is shown in partially exploded form as having a filter material disposed radially between expandable structures. As illustrated best in FIG. 34, an inner tube or base pipe 122 is circumferentially surrounded by an expanding base filter 124. Additionally, a plurality of overlapping filter sheets 126, e.g. four overlapping filter sheets 126, are disposed along the exterior surface of base filter 124. A shroud 128 is disposed around overlapping filter sheets 126 to secure base filter 124 and overlapping filter sheets 126 between base pipe 122 and shroud 128.

In this application, both base pipe 122 and shroud 128 are designed for expansion to a larger diameter. For example, base pipe 122 may comprise one or more bistable cells 130 that facilitate the expansion from a contracted state to an expanded state. Similarly, shroud 128 may comprise one or more bistable cells 132 that facilitate expansion of the shroud from a contracted to an expanded state.

One technique for constructing shroud 128 is to form the shroud in multiple components 134, such as halves that are split generally axially. In this example, the two components 134 are connected to base pipe 122 at their respective ends 136. For example, component ends 136 may be welded to base pipe 122 through base filter 124 by, for example, filet welds at locations generally indicated by arrows 138.

Although overlapping filter sheets 126 may be positioned between base pipe 122 and shroud 128 in a variety of ways, one exemplary way is to secure each sheet 126 to shroud 128. Opposed edges 140 of adjacent filter sheets 126 can be connected to shroud 128 by, for example, a weld 142. By affixing opposed edges 140, overlapping free ends 144 are able to slide past one another as base pipe 122 and shroud 128 are expanded.

Overlapping filter sheets 126 may be formed from a variety of materials, such as a material 146, as illustrated best in FIG. 35. An exemplary woven material 146 is a woven metal fabric having wires 148 woven more or less tightly depending on the desired particle size to be filtered. One specific exemplary material is a woven metal fabric woven in a twilled dutch weave of overlapping wires 148, as illustrated in FIG. 35.

Another exemplary filter material 150 is illustrated in FIG. 36. Filter material 150 comprises a sheet 152 having a plurality of openings 154 formed therethrough. For example, openings 154 may be formed as a multiplicity of tiny slots disposed at a desired angle 156, such as a 45° angle.

If filter material 150 is utilized to form overlapping filter sheets 126, the overlapping sheets typically are oriented in opposite directions. Thus, the slots 154 of one filter sheet 126 intersect the slots 154 of the overlapping adjacent filter sheet 126 to form a multiplicity of smaller openings for filtering particulate matter. In the embodiment illustrated, the sheets can be oriented such that the slots 154 of one filter sheet 126 are oriented at approximately 90° with respect to slots 154 of the adjacent overlapping sheet.

With respect to base filter 124, the filter material is generally wrapped around or disposed along the exterior surface of base pipe 122. The material of base filter 124 may comprise numerous types of filter material that typically are selected to permit an expansion of the material and an increase in opening or pore size during such expansion. Exemplary materials comprise meshes, such as metallic meshes, including woven and non-woven designs.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of controlling filtration in a wellbore environment, comprising:

arranging an expandable tubular system with overlapping filter sheets; and positioning uniquely configured openings in each overlapping filter sheet such that upon expansion of the expandable tubular system, the overlapping filter sheets create a predetermined flow path regime.

2. The method as recited in claim 1, wherein positioning comprises selecting the predetermined flow path regime to create a pressure drop that varies along the length of the expandable tubular system.

3. The method as recited in claim 1, wherein positioning comprises selecting the predetermined flow path regime to create a greater restriction to flow in specific regions of the expandable tubular system relative to other regions of the expandable tubular system.

4. The method as recited in claim 1, further comprising forming the overlapping filter sheets of metal foil.

5. The method as recited in claim 1, wherein positioning comprises forming the uniquely configured openings with differing shapes on respective overlapping filter sheets of a pair of adjacent overlapping filter sheets.

6. The method as recited in claim 1, wherein positioning comprises forming the uniquely configured openings as slots at a first angle in a first filter sheet and as slots at a second angle in a second filter sheet.

7. The method as recited in claim 1, wherein positioning comprises forming the uniquely configured openings such that the openings in a first sheet overlap the openings in a second sheet to create a unique combined openings upon expansion of the expandable tubular system.

8. The method of claim 1, wherein the expandable tubular system comprises a plurality of expandable filter sections and at least one seal section comprising an elastomeric material, wherein the plurality of expandable filter sections are longitudinally separated by the at least one seal section.

9. The method of claim 8, wherein the at least one seal section comprises a plurality of seal sections.

10. The method of claim 8 wherein at least one of the plurality of expandable filter sections are configured to eliminate any annulus between a sand screen and the wellbore.

11. A system for filtering in a wellbore environment, comprising:

a base pipe;

a shroud disposed around the base pipe; and a plurality of filter sheets in which each filter sheet has a free end, wherein the free ends of adjacent pairs of filter sheets are positioned in an overlapping configuration.

12. The system as recited in claim 11, wherein each filter sheet has a plurality of slotted openings.

13. The system as recited in claim 12, wherein the plurality of slotted openings are oriented such that the slotted openings of adjacent pairs of filter sheets crisscross each other.

14. The system as recited in claim 13, wherein the slotted openings of adjacent pairs of filter sheets are crisscrossed at approximately 90 degrees with respect each other.

15. A system for filtering in a wellbore environment, comprising:

a base pipe;

a shroud disposed around the base pipe; and a plurality of filter sheets in which each filter sheet has a free end, wherein the free ends of adjacent pairs of filter sheets are positioned in an overlapping configuration, wherein the plurality of filter sheets are attached to the shroud.

16. A system for filtering in a wellbore environment, comprising:

a base pipe;

a shroud disposed around the base pipe; and a plurality of filter sheets in which each filter sheet has a free end, wherein the free ends of adjacent pairs of filter sheets are positioned in an overlapping configuration, wherein the shroud is formed of a plurality of circumferentially adjacent shroud components.

* * * * *